US007517626B2

(12) United States Patent
Fujii et al.

(10) Patent No.: US 7,517,626 B2
(45) Date of Patent: *Apr. 14, 2009

(54) ELECTROPHOTOGRAPHIC PHOTOSENSITIVE MEMBER, AND ELECTROPHOTOGRAPHIC APPARATUS AND PROCESS CARTRIDGE WHICH MAKE USE OF THE SAME

(75) Inventors: Atsushi Fujii, Kanagawa-ken (JP); Masato Tanaka, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/687,163

(22) Filed: Mar. 16, 2007

(65) Prior Publication Data

US 2007/0154828 A1 Jul. 5, 2007

Related U.S. Application Data

(62) Division of application No. 10/981,564, filed on Nov. 5, 2004, now Pat. No. 7,276,318.

(30) Foreign Application Priority Data

Nov. 26, 2003 (JP) ..... 2003-395880

(51) Int. Cl.
*G03G 5/06* (2006.01)

(52) U.S. Cl. ..... 430/72; 430/56; 399/159

(58) Field of Classification Search ..... 430/56, 430/59.2, 59.4, 72; 399/159
See application file for complete search history.

(56) References Cited

U.S. PATENT DOCUMENTS

| | | | | |
|---|---|---|---|---|
| 5,192,632 | A | 3/1993 | Ohmura et al. | 430/59.2 |
| 5,194,353 | A | 3/1993 | Tanaka et al. | 430/57 |
| 5,527,653 | A | 6/1996 | Tanaka | 430/58 |
| 5,629,116 | A | 5/1997 | Kashizaki et al. | 430/58 |
| 6,040,100 | A | 3/2000 | Tanaka et al. | 430/72 |
| 6,139,997 | A | 10/2000 | Tanaka et al. | 430/56 |
| 6,183,922 | B1 | 2/2001 | Takai et al. | 430/72 |
| 6,218,063 | B1 | 4/2001 | Tanaka et al. | 430/59.4 |

FOREIGN PATENT DOCUMENTS

| | | | |
|---|---|---|---|
| EP | A-0940725 | * | 8/1999 |
| EP | A-0977088 | * | 2/2000 |
| JP | 02-118581 | | 5/1990 |
| JP | 04-81858 | | 3/1992 |
| JP | 04-147265 | | 5/1992 |
| JP | 08-87124 | | 4/1996 |
| JP | 09-240051 | | 9/1997 |
| JP | 10-239956 | | 9/1998 |
| JP | 2000-105478 | | 4/2000 |
| JP | 2002-14482 | | 1/2002 |
| JP | 2002-131951 | | 5/2002 |

OTHER PUBLICATIONS

PTO translation of JP 08087124 pub Apr. 1996.*
Translation of Chinese Office Action in corresponding Chinese Application dated Dec. 8, 2006.
Office Action dated Dec. 20, 2007 issued by EPO on EP 43332.

* cited by examiner

*Primary Examiner*—John L Goodrow
(74) *Attorney, Agent, or Firm*—Fitzpatrick, Cella, Harper & Scinto

(57) ABSTRACT

An electrophotographic photosensitive member having a support and a photosensitive layer sensitive to semiconductor laser light of wavelength from 380 to 500 nm. The photosensitive layer contains (a) a bisazo pigment (i) of the following Formula (1):

Formula (1)

wherein $R_1$ and $R_2$ are each an optionally substituted alkyl group or a halogen atom; $R_3$ and $R_5$ are each a hydrogen atom, $R_4$ and $R_6$ are each a 3 substituted phenyl group where the substitutent is Cl, F, Br, I, nitro, trifluoromethyl, trifluromethoxyl, acetyl or cyano; $Z_1$ and $Z_2$ are each an oxygen atom; $m_1$ and $m_2$ are each 0 to 4; and $n_1$, $n_2$ and $n_3$ are 0; or (b) a bisazo pigment (ii) of Formula (1) wherein $R_1$-$R_6$, $Z_1$, $Z_2$ and $m_1$, $m_2$ are as before $n_1$, $n_2$ and $n_3$ are each $A_1$ and $A_2$ are phenylene and $A_3$ is carbonyl.

6 Claims, 4 Drawing Sheets

ELECTROPHOTOGRAPHIC PHOTOSENSITIVE MEMBER, AND ELECTROPHOTOGRAPHIC APPARATUS AND PROCESS CARTRIDGE WHICH MAKE USE OF THE SAME

This application is a division of U.S. patent application Ser. No. 10/981,564, filed on Nov.5, 2004, the entire disclosure of which is incorporated by reference herein.

BACKGROUND OF THE INVENTION

1. Field of the Invention

This invention relates to an image forming apparatus (electrophotographic apparatus) such as a copying machine, a printer, a facsimile machine or a platemaking system, which employs an electrophotographic process.

2. Related Background Art

In recent years, various approaches are taken because of an increasing need for the achievement of ultrahigh image quality in regard to images reproduced from the image forming apparatus. In particular, the exposure process that forms an electrostatic latent image on the surface of an electrophotographic photosensitive member is positioned on the upstream side in the electrophotographic process, and is the basis of image formation. Accordingly, this process is considered to be an especially important process in order to achieve high image quality of electrophotographic images. Then, making beam spot diameter small in the exposure process enables achievement of ultrahigh resolution, and is a very effective means for the achievement of ultrahigh image quality.

Near infrared region semiconductor lasers having conventionally been used have lasing wavelengths of about 650 to 780 nm, and have spot diameter of about 100 μm. Its limit has been about 50 to 80 μm whatever improvements are made on various optical members in order to make the beam spot diameter small. Also, even if improvements on various optical members have made the beam spot diameter small, it is difficult to obtain the sharpness of a contour of the beam spot. This is known from the diffraction limit of laser beams that is represented by the following equation (48). The following equation (48) shows that the lower limit of beam spot diameter (D) of a beam spot is proportional to the wavelength (λ) of the laser beam. ($N_A$ is the numerical aperture of a lens.)

$$D=1.22\lambda/N_A \tag{48}$$

Accordingly, it is contemplated to use as an exposure light source (a writing light source) of the electrophotographic apparatus a short-wavelength blue (purple) semiconductor laser, which is being put into practical use in DVD and so forth in recent years (see, e.g., Japanese Patent Application Laid-open No. H9-240051, page 2, claim 1). Compared with the conventional near infrared region semiconductor lasers, in the case when the blue (purple) semiconductor laser having about a half lasing wavelength (380 to 500 nm) is used as an exposure light source, the beam spot can be made to have a very small spot diameter in the state the sharpness of the contour of the beam spot is maintained, as shown in the above equation (48). Hence, this enables achievement of ultrahigh resolution, and is very effective for the achievement of ultrahigh image quality.

Thus, the use of the blue (purple) semiconductor laser as an exposure light source makes it possible for the surface of an electrophotographic photosensitive member to be irradiated with a laser beam in a spot diameter of about 40 μm or less in the state the sharpness of its contour is maintained.

Accordingly, in an electrophotographic apparatus having such a blue (purple) semiconductor laser as an exposure light source and made to have a small beam spot diameter, an electrophotographic photosensitive member having a certain or higher sensitivity to light irradiation of an image exposure device is required as a matter of course. Further, in order for the electrophotographic photosensitive member to effectively utilize the light with which it is irradiated, the photosensitive member is required to have a high spectral sensitivity in the wavelength region of the light source.

However, very few electrophotographic photosensitive members have such a high spectral sensitivity in the wavelength region of the light source. For example, Japanese Patent Application Laid-open No. H10-239956, page 5, discloses a report concerning a selenium (Se—Te) photosensitive member which is an inorganic photosensitive member having a maximum spectral sensitivity at a wavelength of about 460 nm.

Meanwhile, in these days, various studies are made which take note of organic photosensitive members having various advantages that they have a good environmental adaptability, can be manufactured and handled with ease, and enjoy a low cost.

For example, Japanese Patent Application Laid-open No. H8-87124 (see page 2, claim 1) discloses an embodiment of an azo pigment making use of a coupler having a similar structure as the present invention. Japanese Patent Applications Laid-open No. H4-147265 (page 8), No. H2-118581 (page 14) and No. H4-81858 (page 13) disclose embodiments of an azo pigment making use of a central skeleton having a similar structure as the present invention. In these cases, however, what is targeted is white light of a halogen lamp or the like as an exposure means, and there is no disclosure at all that it is applied to the use targeted on the blue (purple) semiconductor laser.

In regard to an azo pigment targeted on the blue (purple) semiconductor laser, Japanese Patent Application Laid-open No. H10-239956 (page 3 and FIG. 4 on page 6) discloses an embodiment making use of an anthraquinone type azo pigment, Japanese Patent Application Laid-open No. 2002-14482 (page 2, claims 1 to 4) and Japanese Patent Application Laid-open No. 2002-131951 (pages 2 and 3, claim 1) disclose embodiments making use of azo pigments having various central skeletons, and Japanese Patent Application Laid-open No. 2000-105478 discloses embodiments making use of azo pigments having various couplers. In these cases, however, those having sufficient sensitivity for the blue (purple) semiconductor laser are not seen in the azo pigments having the combination disclosed in the publications.

Accordingly, it follows that images are reproduced in the state the amount of laser light is made extremely large in order to secure the necessary sensitivity. In such a case, the running potential may vary so greatly as to be insufficient for the reproduction of stable images with ultrahigh image quality throughout running. At the same time, there also are various disadvantages that the reliability of lasers to reproduction stability may lower, a high laser cost may result and the laser may have a short lifetime. Moreover, there is a limit to laser power, and proper sensitivity can not always be secured.

On account of the foregoing, it has been sought to use an organic photosensitive member having a high spectral sensitivity for the semiconductor laser light source having the wavelengths of 380 to 500 nm.

SUMMARY OF THE INVENTION

An object of the present invention is to provide an electrophotographic photosensitive member which has a high spectral sensitivity for the blue (purple) semiconductor laser light source, may less cause running potential variations throughout its running and can form stable images with high resolution.

Another object of the present invention is to provide an electrophotographic apparatus, or a process cartridge, having such an electrophotographic photosensitive member.

The present inventors, in order to achieve the above objects, have synthesized a large number of combinations of various central skeletons and various couplers in azo pigments, and have made extensive studies through evaluations. As the result, they have discovered that an electrophotographic photosensitive member in which a bisazo pigment having a certain specific structure constituted of a central skeleton having a certain specific structure and a coupler having a certain specific structure is used in its photosensitive layer has a very high spectral sensitivity for the blue (purple) semiconductor laser light source. Thus, they have enabled solution of the above problems.

The central skeleton having a certain specific structure is a central skeleton having a benzoyl moiety at the terminal, and the coupler having a certain specific structure is a coupler of 2-naphthol having a specific substituent at the 6-position.

More specifically, according to the present invention, there is provided that an electrophotographic photosensitive member comprising a support and a photosensitive layer, and making use of, as writing light, a semiconductor laser light having a wavelength of from 380 to 500 nm, wherein the photosensitive layer comprises a bisazo pigment represented by the following Formula (1):

Formula (1)

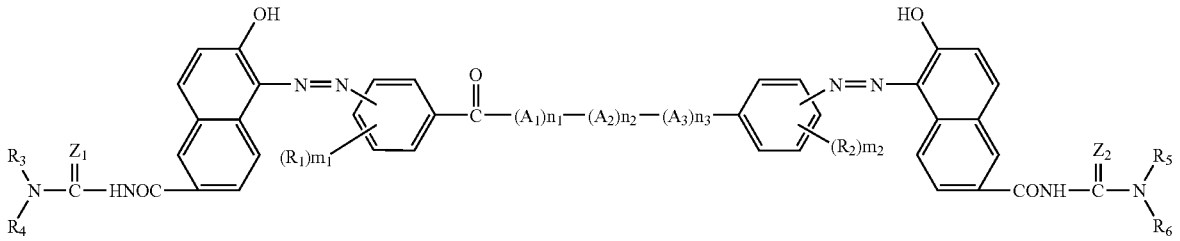

wherein $A_1$, $A_2$ and $A_3$ may be the same or different, and each independently represent a saturated or unsaturated aliphatic hydrocarbon group which may have a substituent, an aromatic hydrocarbon ring group which may have a substituent, a heterocyclic ring group which may have a substituent, or a carbonyl group; $R_1$ and $R_2$ may be the same or different, and each independently represent an alkyl group which may have a substituent, an aryl group which may have a substituent, or a halogen atom; $R_3$, $R_4$, $R_5$ and $R_6$ may be the same or different, and each independently represent a hydrogen atom, an alkyl group which may have a substituent, an aryl group which may have a substituent, a heterocyclic ring group which may have a substituent, or an aralkyl group which may have a substituent, provided that $R_3$ and $R_4$, and $R_5$ and $R_6$, may each form a cyclic amino group via the nitrogen atom in the formula; $Z_1$ and $Z_2$ each independently represent an oxygen atom or a sulfur atom; $m_1$ and $m_2$ each represent an integer of 0 to 4; and $n_1$, $n_2$ and $n_3$ each independently represent 0 or 1.

According to the present invention, there is also provided that an electrophotographic apparatus comprising the above electrophotographic photosensitive member, a charging means, an exposure means comprising semiconductor laser light having a wavelength of from 380 to 500 nm, a developing means and a transfer means.

According to the present invention, there is still also provided that a process cartridge comprising at least one means selected from the group consisting of the above electrophotographic photosensitive member, a charging means, a developing means and a cleaning means which are integrally supported, and is detachably mountable to the main body of an electrophotographic apparatus.

According to the present invention, inasmuch as the bisazo pigment with a specific structure is used in the photosensitive layer, an electrophotographic photosensitive member can be provided which has a high spectral sensitivity for the blue (purple) semiconductor laser light source and can effectively utilize irradiation light. Also, it may less cause running potential variations throughout its running and can form stable images with high resolution.

DESCRIPTION OF THE PREFERRED EMBODIMENTS

The present invention is described below in detail.

Figure 1:
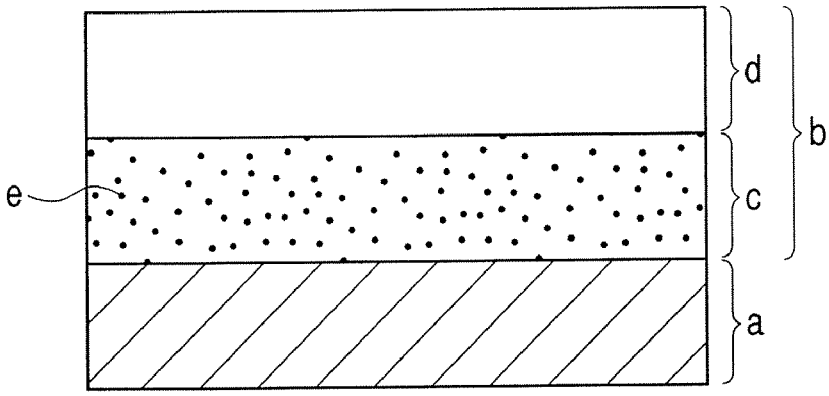
FIG. 1 is a sectional view showing an example of layer configuration of an organic photosensitive member.
Figure 2:
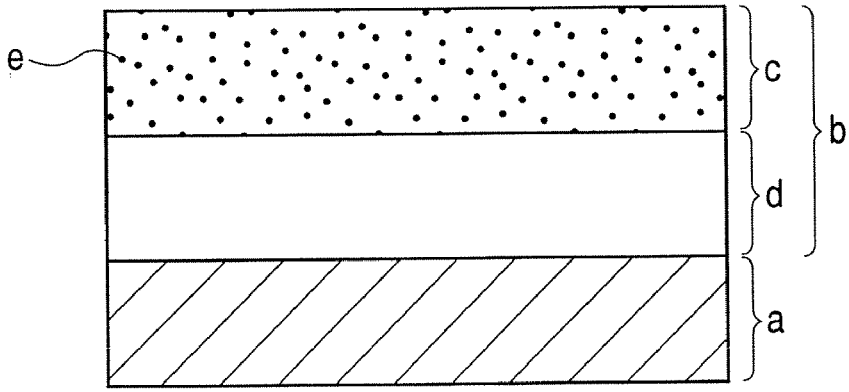
FIG. 2 is a sectional view showing another example of layer configuration of an organic photosensitive member.
Figure 3:
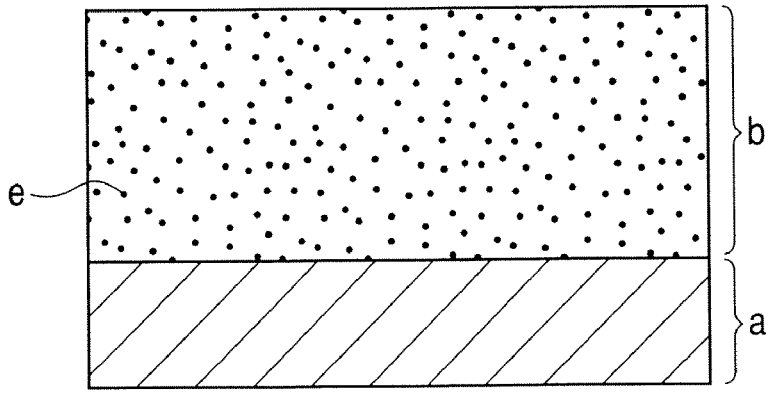
FIG. 3 is a sectional view showing still another example of layer configuration of an organic photosensitive member.

The electrophotographic photosensitive member of the present invention is described. As to the layer configuration of the electrophotographic photosensitive member, it may be any known layer configuration as shown in FIGS. 1 to 3. Of these, it may preferably be the layer configuration shown in FIG. 1. In FIGS. 1 to 3, letter symbol a denotes a support; b, a photosensitive layer; c, a charge generation layer; d, a charge transport layer; and e, a charge-generating material.

In regard to a function-separated organic photosensitive member comprising a support and superposed thereon a charge generation layer and a charge transport layer in this order, a manner for its manufacture is described below.

As materials for the support, they may at least be those having conductivity. For example, usable are aluminum, aluminum alloys, copper, zinc, stainless steel, vanadium, molybdenum, chromium, titanium, nickel, indium, gold and platinum. Also usable are a plastic support (such as a polyethylene, polypropylene, polyvinyl chloride, polyethylene terephthalate or acrylic resin support) film-formed thereon by vacuum deposition of any of these metals or an alloy thereof; a support formed of the above plastic, metal or alloy and coated thereon with conductive particles (such as carbon black or silver particles) together with a suitable binder resin; and a support formed of plastic or paper impregnated therein with conductive particles.

On the support, a conductive layer may be provided which is intended for the covering of unevenness or defects of the support or for the prevention of interference fringes.

This conductive layer may be formed by coating the support with a dispersion prepared by dispersing conductive particles such as carbon black, metal particles or metal oxide particles in a binder resin. The conductive layer may preferably be in a layer thickness of from 1 μm to 40 μm, and particularly preferably from 1 μm to 30 μm.

The surface of the support made of aluminum or an aluminum alloy may also be subjected to roughing by honing, centerless grinding, cutting or the like. By such roughing, the surface of the support can further be designed to have an appropriate roughness, making it possible to execute a countermeasure against interference fringes. The support may preferably have a ten-point average roughness Rz jis of 0.05 μm or more, and particularly preferably 0.1 μm or more.

The ten-point average roughness Rz jis is measured according to JIS B 0610 (2001) by means of SURFCORDER SE-3500 (manufactured by Kosaka Laboratory Ltd.), setting the cut-off to 0.8 mm and measurement length to 8 mm.

An intermediate layer having the function as a barrier and the function of adhesion may also be provided on the support or conductive layer. As materials for the intermediate layer, usable are polyvinyl alcohol, polyethylene oxide, ethyl cellulose, methyl cellulose, casein, polyamide, glue and gelatin. Any of these materials may be dissolved in a suitable solvent, followed by coating on the support or conductive layer. The intermediate layer may preferably be in a layer thickness of from 0.2 μm to 3.0 μm.

On the support, conductive layer or intermediate layer, the charge generation layer is provided.

The charge generation layer may be formed by coating on the support, conductive layer or intermediate layer a fluid prepared by dispersing a charge-generating material in a suitable solvent together with a binder resin; followed by drying.

As the charge-generating material, a bisazo pigment represented by the following Formula (1):

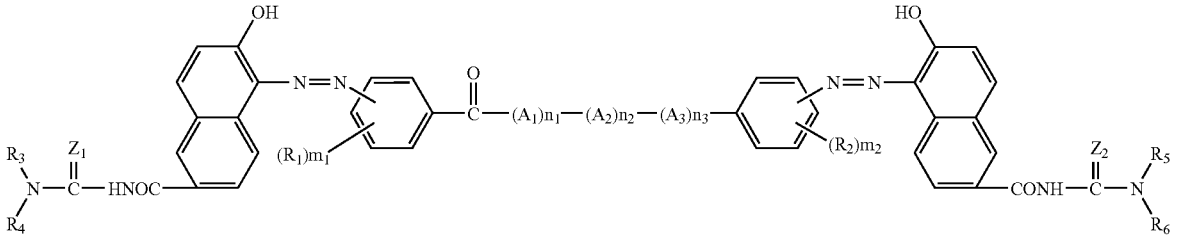

is used.

In the above Formula (1), $A_1$, $A_2$ and $A_3$ may be the same or different, and each independently represent a saturated or unsaturated aliphatic hydrocarbon group which may have a substituent, an aromatic hydrocarbon ring group which may have a substituent, a heterocyclic ring group which may have a substituent, or a carbonyl group; $R_1$ and $R_2$ may be the same or different, and each independently represent an alkyl group which may have a substituent, an aryl group which may have a substituent, or a halogen atom; $R_3$, $R_4$, $R_5$ and $R_6$ may be the same or different, and each independently represent a hydrogen atom, an alkyl group which may have a substituent, an aryl group which may have a substituent, a heterocyclic ring group which may have a substituent, or an aralkyl group which may have a substituent, provided that $R_3$ and $R_4$, and $R_5$ and $R_6$, may each form a cyclic amino group via the nitrogen atom in the formula; $Z_1$ and $Z_2$ each independently represent an oxygen atom or a sulfur atom; $m_1$ and $m_2$ each represent an integer of 0 to 4; and $n_1$, $n_2$ and $n_3$ each independently represent 0 or 1.

Stated specifically, the groups represented by $A_1$, $A_2$ and $A_3$ in the above Formula (1) may each independently include saturated aliphatic hydrocarbon groups such as methylene, ethylene, trimethylene and tetramethylene; unsaturated aliphatic hydrocarbon group such as vinylene and propenylene; aromatic hydrocarbon ring groups such as benzene, naphthalene, fluorene, phenanthrene, anthracene and pyrene; heterocyclic ring groups such as furan, thiophene, pyridine, indole, benzothiazole, carbazole, acridone, benzoxazole, oxadiazole and thiazole; and a carbonyl group.

The substituent these groups may have may include alkyl groups such as methyl, ethyl, propyl and butyl; alkoxyl groups such as methoxyl, ethoxyl and propoxyl; halogen atoms such as a fluorine atom, a chlorine atom and a bromine atom; dialkylamino groups such as dimethylamino and diethylamino; and a hydroxyl group, a nitro group, a cyano group, and halomethyl groups.

The group represented by each of $A_1$, $A_2$ and $A_3$ may more preferably include a phenylene group, a carbonyl group, a vinylene group and a methylene group, which are respectively represented by formulas in the following Formula (2).

Formula (2)

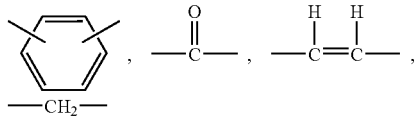

It may still more preferably be a phenylene group, which is represented by the following Formula (3):

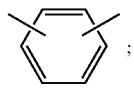

a carbonyl group, which is represented by the following Formula (4):

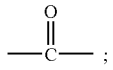

a vinylene group, which is represented by the following Formula (5):

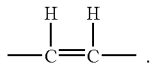

$R_1$ and $R_2$ may be the same or different and each independently represent an alkyl group such as a methyl group or an ethyl group, which may have a substituent, an aryl group such as a phenyl group or a naphthyl group, which may have a substituent, or a halogen atom such as a fluorine atom or a chlorine atom. The substituent may include alkyl groups such as a methyl group and an ethyl group, aryl groups such as a phenyl group and a naphthyl group, and halogen atoms such as a fluorine atom and a chlorine atom. $m_1$ and $m_2$ each represent an integer of 0 to 4.

$R_3$, $R_4$, $R_5$ and $R_6$ may be the same or different, and each independently represent a hydrogen atom, an alkyl group such as a methyl group or an ethyl group, which may have a substituent, an aryl group such as a phenyl group or a naphthyl group, which may have a substituent, a heterocyclic ring group such as furan, thiophene, pyridine, indole, benzothiazole, carbazole, acridone, benzoxazole, oxadiazole or thiazole; or an aralkyl group such as a benzyl group or a phenethyl group, which may have a substituent. The substituent may include alkyl groups such as methyl and ethyl; alkoxyl groups such as methoxyl and ethoxyl; halogen atoms such as a fluorine atom and a chlorine atom; dialkylamino groups such as dimethylamino and diethylamino; and a hydroxyl group, a nitro group, a cyano group, halomethyl groups, halomethoxyl groups, an acetyl group and a phenylcarbamoyl group. Incidentally, the phenyl group of this phenylcarbamoyl group may further have a substituent such as the one described above.

$R_3$ and $R_4$, and $R_5$ and $R_6$, may also each form a cyclic amino group via the nitrogen atom in the formula. The cyclic amino group containing a nitrogen atom in the ring may include pyrrole, pyrroline, pyrrolidine, pyrrolidone, indole, indoline, carbazole, imidazole, pyrazole, pyrazoline, oxazine and phenoxazine.

$Z_1$ and $Z_2$ each independently represent an oxygen atom or a sulfur atom.

In particular, a case in which $R_3$ and $R_5$ are each a hydrogen atom and $Z_1$ and $Z_2$ are each an oxygen atom is preferred in view of sensitivity. Further preferred in view of sensitivity is a case in which $R_4$ and $R_6$ are each independently an aryl group which may have a substituent, and further a case in which $R_4$ and $R_6$ are each independently a phenyl group which may have a substituent. Particularly preferred in view of sensitivity is a case in which $R_4$ and $R_6$ are each independently a phenyl group which has been substituted with at least one group selected from the group consisting of a chlorine atom, a fluorine atom, a bromine atom, an iodine atom, a nitro group, a trifluoromethyl group, a trifluoromethoxyl group, an acetyl group and a cyano group.

To describe more specifically the azo compound (bisazo pigment) represented by the above Formula (1), compounds having structures given in the following (i) to (xvi) may preferably be used in the present invention.

(i) A compound in which $n_1$, $n_2$ and $n_3$ are 0.

(ii) A compound in which $n_1$, $n_2$ and $n_3$ are 0, and also $R_3$ and $R_5$ are each a hydrogen atom, $R_4$ and $R_6$ are each independently a phenyl group substituted with at least one selected from the group consisting of a chlorine atom, a fluorine atom, a bromine atom, an iodine atom, a nitro group, a trifluoromethyl group, a trifluoromethoxyl group, an acetyl group and a cyano group, and $Z_1$ and $Z_2$ are each an oxygen atom.

(iii) A compound in which $n_1$ is 1 and $n_2$ and $n_3$ are 0, and $A_1$ is a group selected from the group consisting of groups represented by formulas in the above Formula (2).

(iv) A compound in which $n_1$ is 1, $n_2$ and $n_3$ are each 0, $A_1$ is a group selected from the group consisting of groups represented by the above Formula (2), $R_3$ and $R_5$ are each a hydrogen atom, $R_4$ and $R_6$ are each independently a phenyl group substituted with at least one selected from the group consisting of a chlorine atom, a fluorine atom, a bromine atom, an iodine atom, a nitro group, a trifluoromethyl group, a trifluoromethoxyl group, an acetyl group and a cyano group, and $Z_1$ and $Z_2$ are each an oxygen atom.

(v) A compound in which $n_1$ is 1, $n_2$ and $n_3$ are each 0, and $A_1$ is any one of groups represented by the above Formulas (3) to (5).

(vi) A compound in which $n_1$ is 1 and $n_2$ and $n_3$ are 0, $A_1$ is a group selected from the group consisting of groups represented by the above Formulas (3) to (5), $R_3$ and $R_5$ are each a hydrogen atom, $R_4$ and $R_6$ are each independently a phenyl group substituted with at least one selected from the group consisting of a chlorine atom, a fluorine atom, a bromine atom, an iodine atom, a nitro group, a trifluoromethyl group, a trifluoromethoxyl group, an acetyl group and a cyano group, and $Z_1$ and $Z_2$ are each an oxygen atom.

(vii) A compound in which $n_1$ and $n_2$ are 1 and $n_3$ is 0, and $A_1$ and $A_2$ are each independently any one of groups represented by formulas in the above Formula (2).

(viii) A compound in which $n_1$ and $n_2$ are 1 and $n_3$ is 0, $A_1$ and $A_2$ are each independently a group selected from the group consisting of groups represented by formulas in the above Formula (2), $R_3$ and $R_5$ are each a hydrogen atom, $R_4$ and $R_6$ are each independently a phenyl group substituted with at least one selected from the group consisting of a chlorine atom, a fluorine atom, a bromine atom, an iodine atom, a nitro group, a trifluoromethyl group, a trifluoromethoxyl group, an acetyl group and a cyano group, and $Z_1$ and $Z_2$ are each an oxygen atom.

(ix) A compound in which $n_1$ and $n_2$ are each 1, $n_3$ is 0, $A_1$ is a group represented by the above Formula (3), and $A_2$ is a group represented by the above Formula (4).

(x) A compound in which $n_1$ and $n_2$ are each 1, $n_3$ is 0, $A_1$ is a group represented by the above Formula (3), $A_2$ is a group represented by the above Formula (4), $R_3$ and $R_5$ are each a hydrogen atom, $R_4$ and $R_6$ are each independently a phenyl group susbstituted with at least one selected from the group consisting of a chlorine atom, a fluorine atom, a bromine atom, an iodine atom, a nitro group, a trifluoromethyl group, a trifluoromethoxyl group, an acetyl group and a cyano group, and $Z_1$ and $Z_2$ are each an oxygen atom.

(xi) A compound in which $n_1$ and $n_2$ are each 1, $n_3$ is 0, $A_1$ is a group represented by the above Formula (6), and $A_2$ is a group represented by the above Formula (4).

(xii) A compound in which $n_1$ and $n_2$ are each 1, $n_3$ is 0, $A_1$ is a group represented by the above Formula (6), $A_2$ is a group represented by the above Formula (4), $R_3$ and $R_5$ are each a hydrogen atom, $R_4$ and $R_6$ are each independently a phenyl group substituted with at least one selected from the group consisting of a chlorine atom, a fluorine atom, a bromine atom, an iodine atom, a nitro group, a trifluoromethyl group, a trifluoromethoxyl group, an acetyl group and a cyano group, and $Z_1$ and $Z_2$ are each an oxygen atom.

(xiii) A compound in which $n_1$, $n_2$ and $n_3$ are each 1, $A_1$, $A_2$ and $A_3$ are each independently a group selected from the group consisting groups represented by formulas in the above Formula (2).

(xiv) A compound in which $n_1$, $n_2$ and $n_3$ are each 1, $A_1$, $A_2$ and $A_3$ are each independently a group selected from the group consisting of groups represented by formulas in the above Formula (2), $R_3$ and $R_5$ are each a hydrogen atom, $R_4$ and $R_6$ are each independently a phenyl group substituted with at least one selected from the group consisting of a chlorine atom, a fluorine atom, a bromine atom, an iodine atom, a nitro group, a trifluoromethyl group, a trifluoromethoxyl group, an acetyl group and a cyano group, and $Z_1$ and $Z_2$ are each an oxygen atom.

(xv) A compound in which $n_1$, $n_2$ and $n_3$ are each 1, $A_1$ and $A_2$ are each a group represented by the above Formula (3), and $A_3$ is a group represented by the above Formula (4).

(xvi) A compound in which $n_1$, $n_2$ and $n_3$ are each 1, $A_1$ and $A_2$ are each a group represented by the above Formula (3), $A_3$ is a group represented by the above Formula (4), $R_3$ and $R_5$ are each a hydrogen atom, $R_4$ and $R_6$ are each independently a phenyl group substituted with at least one selected from the group consisting of a chlorine atom, a fluorine atom, a bromine atom, an iodine atom, a nitro group, a trifluoromethyl group, a trifluoromethoxyl group, an acetyl group and a cyano group, and $Z_1$ and $Z_2$ are each an oxygen atom.

All the bisazo pigments may also have a crystal form which may be crystalline or may be amorphous.

Preferable exemplary compounds of the bisazo pigment which are usable in the present invention are enumerated below. Examples are by no means limited to these. As to structural formulas concerning the bisazo pigments, those represented by Formula (1) are grouped into Basic Pattern I, Basic Pattern II and Basic Pattern III in accordance with the position of substitution on the azo group, and only moieties corresponding to $A_1$ to $A_3$, $R_1$ to $R_6$, $Z_1$ and $Z_2$, and $n_1$ to $n_3$ are listed in Tables 1 to 14 (Exemplary Compound 1-1 to Exemplary Compound 14-5) in respect to the respective basic patterns.

Basic Pattern I

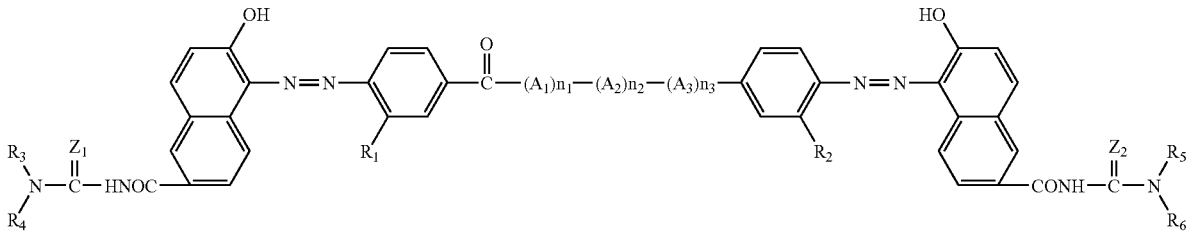

Basic Pattern II

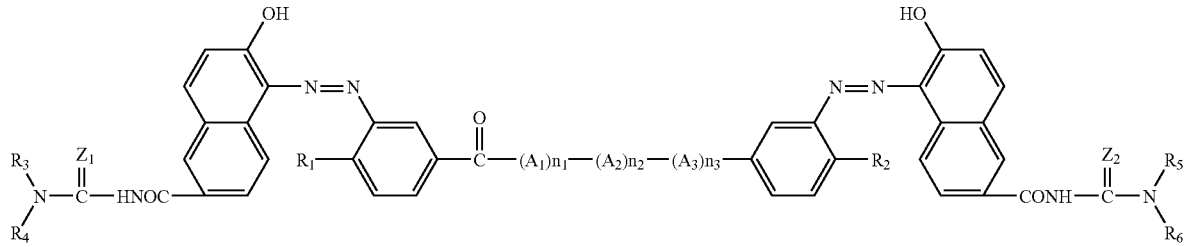

Basic Pattern III

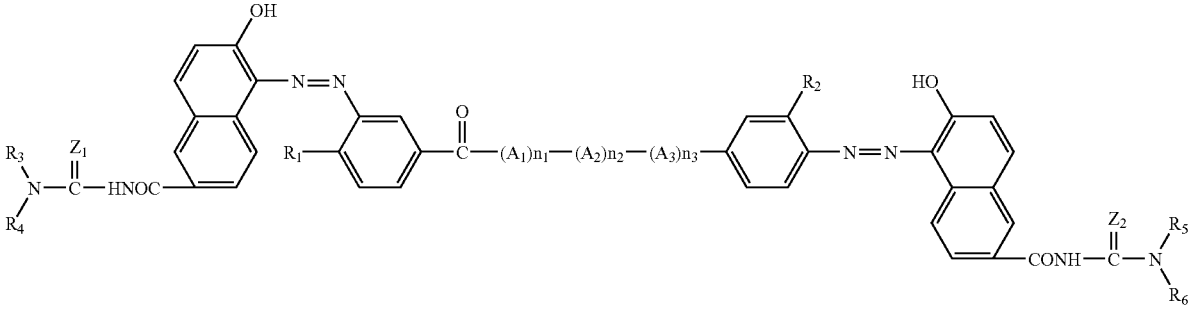

TABLE 1
Case of $n_1 = n_2 = n_3 = 0$ in Basic Pattern I
| Exemplary Compound | R1 | R2 | Z1 | Z2 | R3 | R4 | R5 | R6 |
|---|---|---|---|---|---|---|---|---|
| 1-1 | — | — | O | O | H | 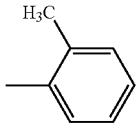 | H | 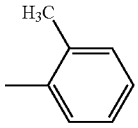 |
| 1-2 | — | — | O | O | H | $—CH_3$ | H | $—CH_3$ |
| 1-3 | — | — | O | O | H | 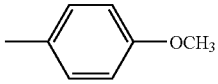 | H | 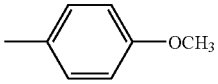 |
| 1-4 | — | — | O | O | H | 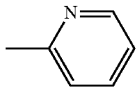 | H | 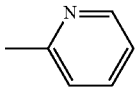 |
| 1-5 | — | — | O | O | H | 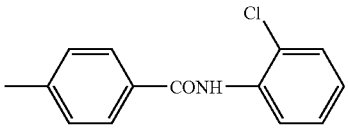 | H | 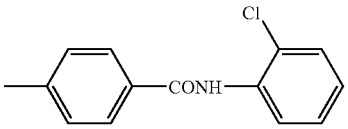 |
| 1-6 | — | — | O | O | H | 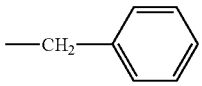 | H | 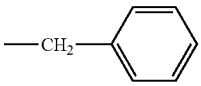 |
| 1-7 | — | — | O | O | H | 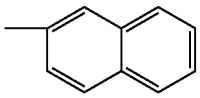 | H | 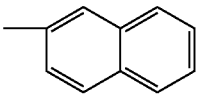 |
| 1-8 | — | — | O | O | H | 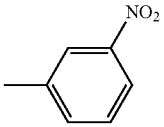 | H | 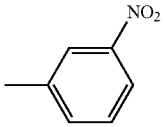 |
| 1-9 | — | — | O | O | H | 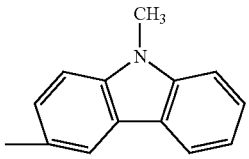 | H | 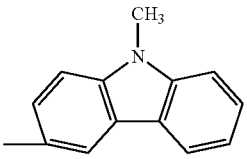 |
| 1-10 | — | — | O | O | $—CH_3$ | 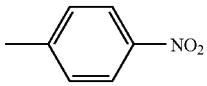 | $—CH_3$ | 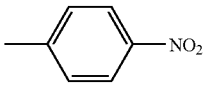 |
| 1-11 | — | — | O | O | H | 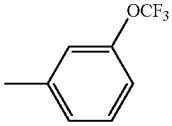 | H | 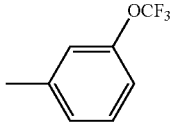 |
| 1-12 | — | — | O | O | H | 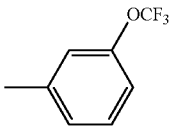 | H | 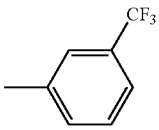 |

TABLE 1-continued
Case of $n_1 = n_2 = n_3 = 0$ in Basic Pattern I
| Exemplary Compound | R1 | R2 | Z1 | Z2 | R3 | R4 | R5 | R6 |
|---|---|---|---|---|---|---|---|---|
| 1-13 | — | — | O | O | H | 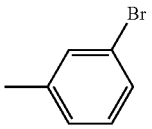 | H | 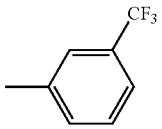 |
| 1-14 | — | — | O | O | H | 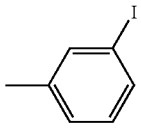 | H | 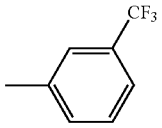 |
| 1-15 | — | — | O | O | H | 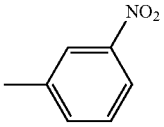 | H | 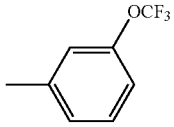 |
TABLE 2
Case of $n_1 = n_2 = n_3 = 0$ in Basic Pattern I
| Exemplary Compound | R1 | R2 | Z1 | Z2 | R3 | R4 | R5 | R6 |
|---|---|---|---|---|---|---|---|---|
| 2-1 | — | — | O | O | 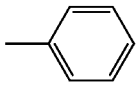 | 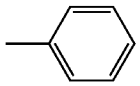 | 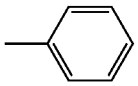 | 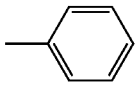 |
| 2-2 | — | — | O | O | H | 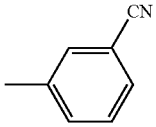 | H | 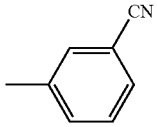 |
| 2-3 | — | — | O | O | H | 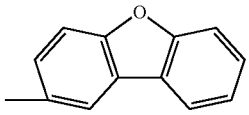 | H | 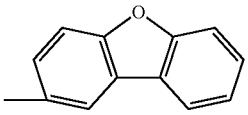 |
| 2-4 | — | — | O | O | H | 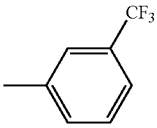 | H | 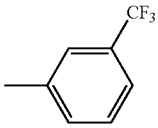 |
| 2-5 | — | — | O | O | H | 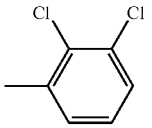 | H | 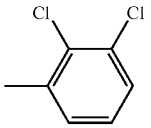 |
| 2-6 | — | — | O | O | H | 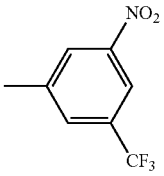 | H | 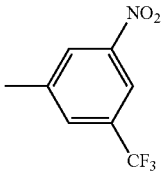 |

TABLE 2-continued
Case of $n_1 = n_2 = n_3 = 0$ in Basic Pattern I
| Exemplary Compound | R1 | R2 | Z1 | Z2 | R3 | R4 | R5 | R6 |
|---|---|---|---|---|---|---|---|---|
| 2-7 | — | — | O | O | H | 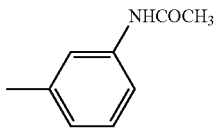 | H | 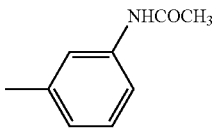 |
| 2-8 | — | — | O | O | H | 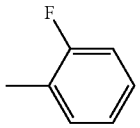 | H | 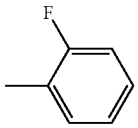 |
| 2-9 | — | — | O | O | H | 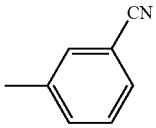 | H | 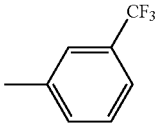 |
| 2-10 | — | — | O | O | H | 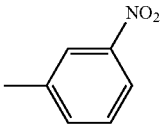 | H | 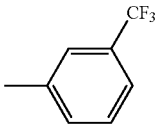 |
| 2-11 | — | — | O | O | H | 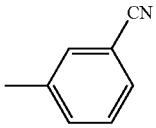 | H | 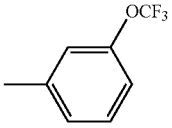 |
| 2-12 | — | — | O | O | H | 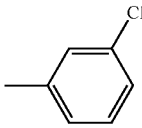 | H | 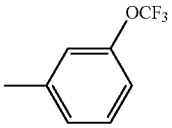 |
| 2-13 | — | — | O | O | H | 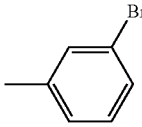 | H | 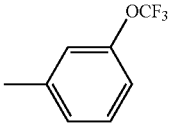 |
| 2-14 | — | — | O | O | H | 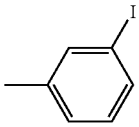 | H | 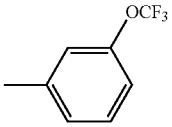 |
| 2-15 | — | — | O | O | H | 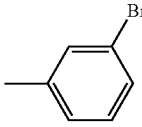 | H | 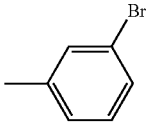 |

TABLE 3
Case of $n_1 = n_2 = n_3 = 0$ in Basic Pattern I
| Exemplary Compound | R1 | R2 | Z1 | Z2 | R3 | R4 | R5 | R6 |
|---|---|---|---|---|---|---|---|---|
| 3-1 | — | — | O | O | H | 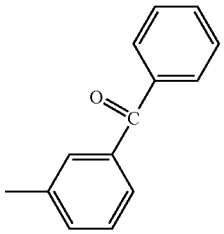 | H | 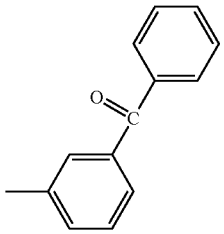 |
| 3-2 | — | — | O | O | | 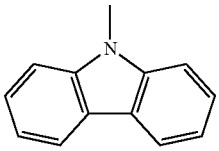 | | 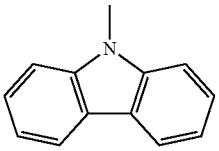 |
| 3-3 | — | — | O | O | H | 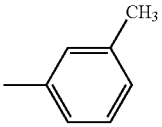 | H | 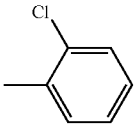 |
| 3-4 | — | — | O | O | H | 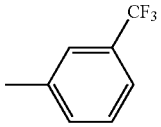 | H | 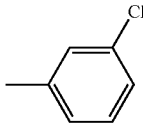 |
| 3-5 | Cl | Cl | O | O | H | 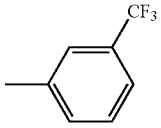 | H | 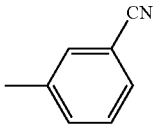 |
| 3-6 | Cl | Cl | O | O | H | 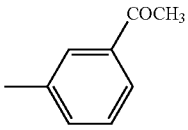 | H | 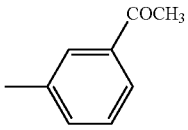 |
| 3-7 | CH3 | CH3 | O | O | H | 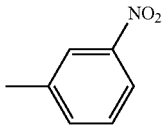 | H | 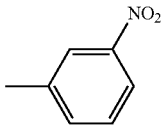 |
| 3-8 | CH3 | CH3 | O | O | H | 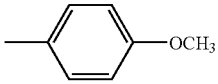 | H | 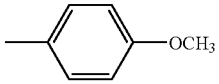 |
| 3-9 | — | — | S | S | H | 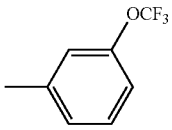 | H | 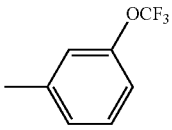 |
| 3-10 | — | — | S | S | H | 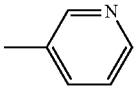 | H | 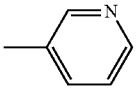 |

TABLE 3-continued
Case of $n_1 = n_2 = n_3 = 0$ in Basic Pattern I
| Exemplary Compound | R1 | R2 | Z1 | Z2 | R3 | R4 | R5 | R6 |
|---|---|---|---|---|---|---|---|---|
| 3-11 | — | — | O | O | H | 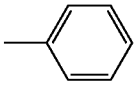 | H | 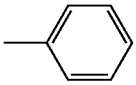 |
| 3-12 | — | — | O | O | H | 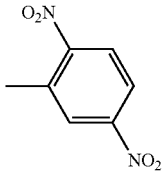 | H | 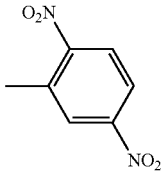 |
| 3-13 | — | — | O | O | H | 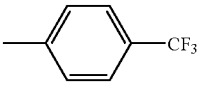 | H | 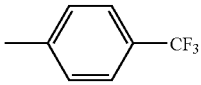 |
| 3-14 | — | — | O | O | H | 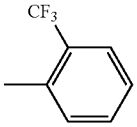 | H | 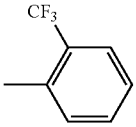 |
TABLE 4
Case of $n_1 = n_2 = n_3 = 0$ in Basic Pattern II
| Exemplary Compound | R1 | R2 | Z1 | Z2 | R3 | R4 | R5 | R6 |
|---|---|---|---|---|---|---|---|---|
| 4-1 | — | — | O | O | H | 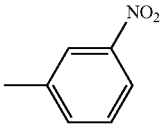 | H | 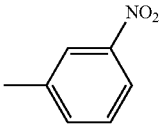 |
| 4-2 | — | — | O | O | H | 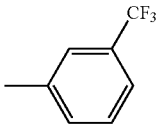 | H | 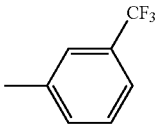 |
| 4-3 | — | — | O | O | H | 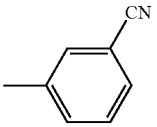 | H | 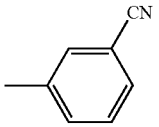 |
| 4-4 | — | — | O | O | H | 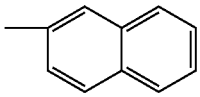 | H | 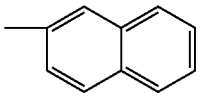 |
| 4-5 | — | — | O | O | H | 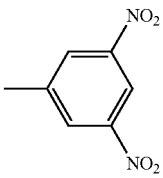 | H | 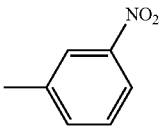 |

TABLE 4-continued
Case of $n_1 = n_2 = n_3 = 0$ in Basic Pattern II
| Exemplary Compound | R1 | R2 | Z1 | Z2 | R3 | R4 | R5 | R6 |
|---|---|---|---|---|---|---|---|---|
| 4-6 | — | — | O | O | H | 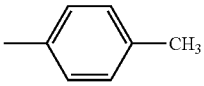 | H | 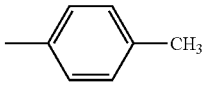 |
| 4-7 | Cl | Cl | O | O | H | 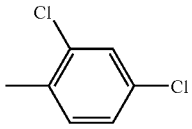 | H | 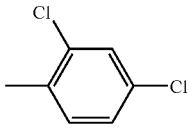 |
| 4-8 | Cl | Cl | O | O | H | 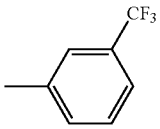 | H | 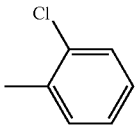 |
| 4-9 | F | F | O | O | H | 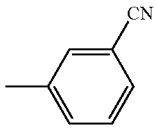 | H | 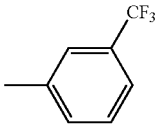 |
| 4-10 | CH3 | CH3 | O | O | H | 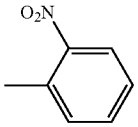 | H | 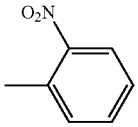 |
| 4-11 | — | — | O | O | H | 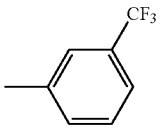 | H | 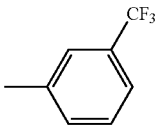 |
TABLE 5
Case of $n_1 = n_2 = n_3 = 0$ in Basic Pattern III
| Exemplary Compound | R1 | R2 | Z1 | Z2 | R3 | R4 | R5 | R6 |
|---|---|---|---|---|---|---|---|---|
| 5-1 | — | — | O | O | H | 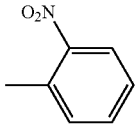 | H | 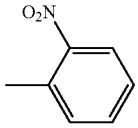 |
| 5-2 | — | — | O | O | H | 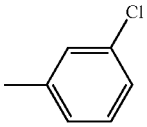 | H | 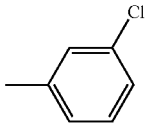 |
| 5-3 | — | — | O | O | H | 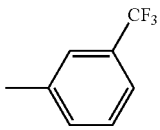 | H | 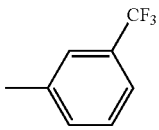 |

TABLE 5-continued
Case of $n_1 = n_2 = n_3 = 0$ in Basic Pattern III
| Exemplary Compound | R1 | R2 | Z1 | Z2 | R3 | R4 | R5 | R6 |
|---|---|---|---|---|---|---|---|---|
| 5-4 | — | — | O | O | H | 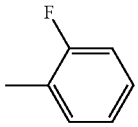 | H | 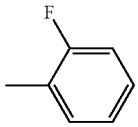 |
| 5-5 | — | — | O | O | H | 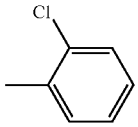 | H | 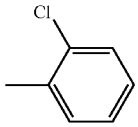 |
| 5-6 | — | — | O | O | H | 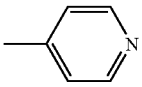 | H | 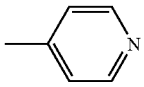 |
| 5-7 | — | — | O | O | | 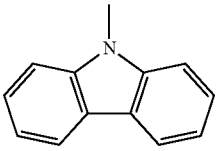 | | 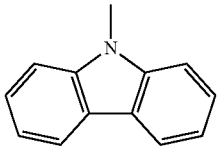 |
| 5-8 | — | — | O | O | H | —C2H5 | H | —C2H5 |
| 5-9 | — | — | O | O | H | 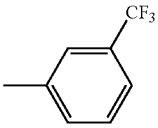 | H | 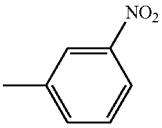 |
| 5-10 | — | — | O | O | H | 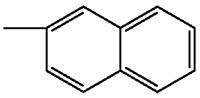 | H | 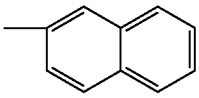 |
TABLE 6
Case of $n_1 = 1$, $n_2 = n_3 = 0$ in Basic Pattern I
| Exemplary Compound | R1 | R2 | Z1 | Z2 | A1 | R3 | R4 | R5 | R6 |
|---|---|---|---|---|---|---|---|---|---|
| 6-1 | — | — | O | O | 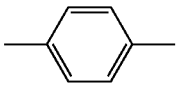 | H | 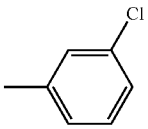 | H | 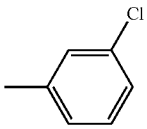 |
| 6-2 | — | — | O | O | 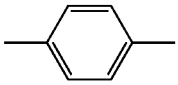 | H | 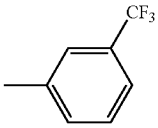 | H | 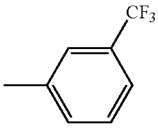 |
| 6-3 | — | — | O | O | 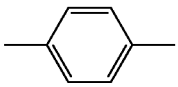 | 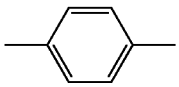 | 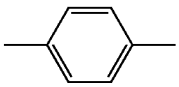 | 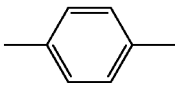 | 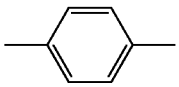 |

TABLE 6-continued
Case of $n_1 = 1$, $n_2 = n_3 = 0$ in Basic Pattern I
| Exemplary Compound | R1 | R2 | Z1 | Z2 | A1 | R3 | R4 | R5 | R6 |
|---|---|---|---|---|---|---|---|---|---|
| 6-4 | — | — | O | O | 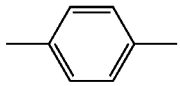 | H | 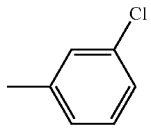 | H | 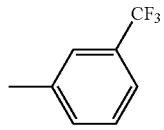 |
| 6-5 | — | — | O | O | 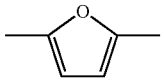 | H | 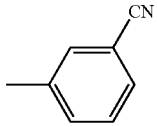 | H | 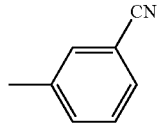 |
| 6-6 | — | — | O | O | 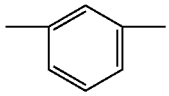 | H | 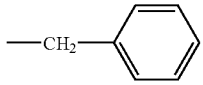 | H | 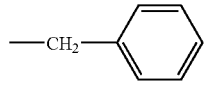 |
| 6-7 | — | — | O | O | 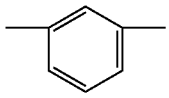 | H | 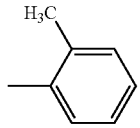 | H | 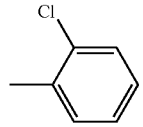 |
| 6-8 | — | — | O | O | 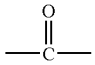 | H | 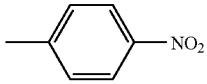 | H | 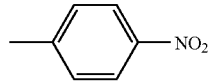 |
| 6-9 | — | — | O | O | 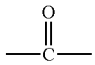 | | 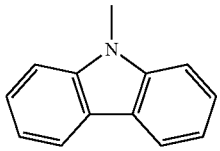 | | 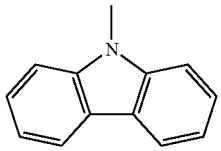 |
| 6-10 | — | — | O | O | 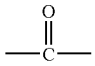 | H | 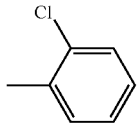 | H | 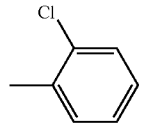 |
| 6-11 | — | — | O | O | 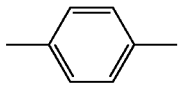 | H | 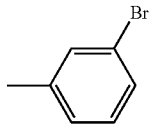 | H | 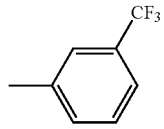 |
| 6-12 | — | — | O | O | 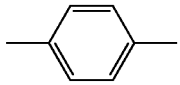 | H | 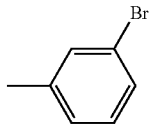 | H | 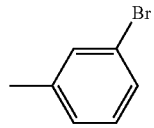 |
| 6-13 | — | — | O | O | 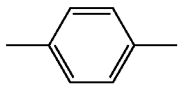 | H | 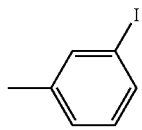 | H | 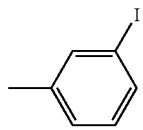 |

TABLE 6-continued
| Exemplary Compound | R1 | R2 | Z1 | Z2 | A1 | R3 | R4 | R5 | R6 |
|---|---|---|---|---|---|---|---|---|---|
| | | | | | Case of $n_1 = 1$, $n_2 = n_3 = 0$ in Basic Pattern I | | | | |
| 6-14 | — | — | O | O | 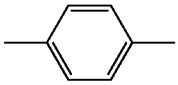 | H | 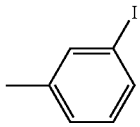 | H | 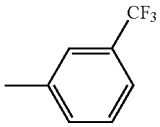 |
| 6-15 | — | — | O | O | 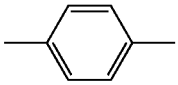 | H | 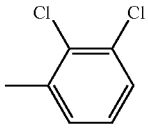 | H | 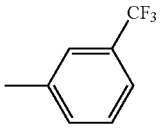 |
TABLE 7
| Exemplary Compound | R1 | R2 | Z1 | Z2 | A1 | R3 | R4 | R5 | R6 |
|---|---|---|---|---|---|---|---|---|---|
| | | | | | Case of $n_1 = 1$, $n_2 = n_3 = 0$ in Basic Pattern I | | | | |
| 7-1 | — | — | O | O | 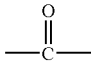 | H | 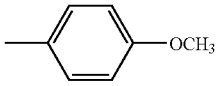 | H | 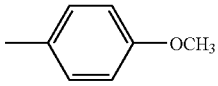 |
| 7-2 | — | — | O | O | 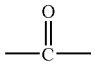 | H | 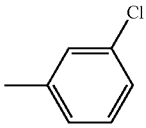 | H | 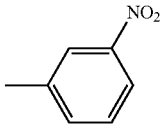 |
| 7-3 | — | — | O | O | 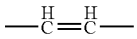 | H | 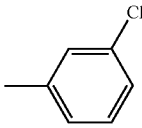 | H | 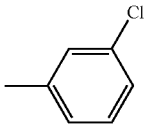 |
| 7-4 | — | — | O | O | 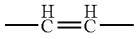 | H | 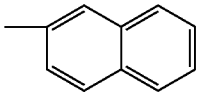 | H | 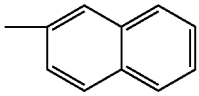 |
| 7-5 | — | — | O | O | 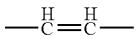 | H | 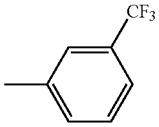 | H | 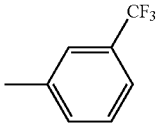 |
| 7-6 | — | — | O | O | 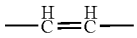 | H | 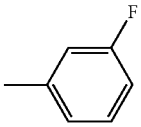 | H | 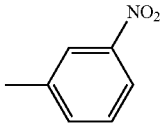 |
| 7-7 | — | — | O | O | 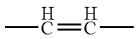 | H | 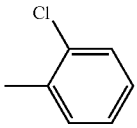 | H | 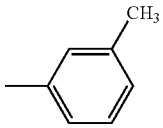 |

TABLE 7-continued
Case of $n_1 = 1$, $n_2 = n_3 = 0$ in Basic Pattern I
| Exemplary Compound | R1 | R2 | Z1 | Z2 | A1 | R3 | R4 | R5 | R6 |
|---|---|---|---|---|---|---|---|---|---|
| 7-8 | — | — | O | O | 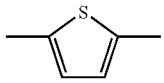 | H | 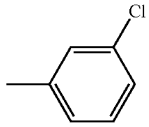 | H | 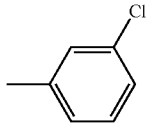 |
| 7-9 | — | — | O | O | —CH2— | H | 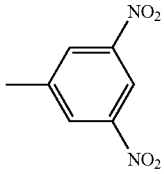 | H | 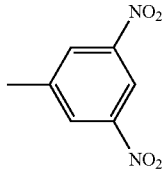 |
| 7-10 | — | — | O | O | —CH2— | —CH3 | 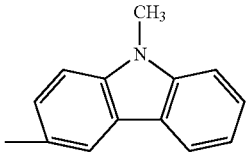 | —CH3 | 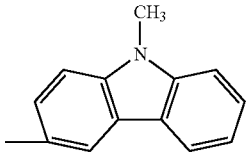 |
| 7-11 | — | — | O | O | 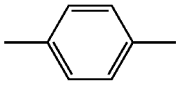 | H | 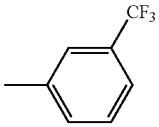 | H | 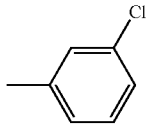 |
| 7-12 | — | — | O | O | 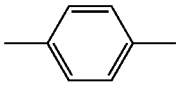 | H | 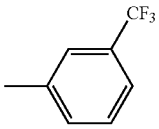 | H | 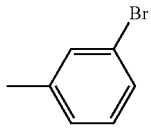 |
| 7-13 | — | — | O | O | 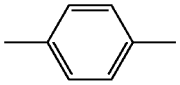 | H | 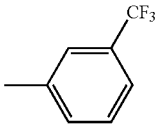 | H | 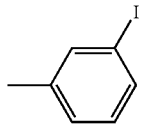 |
| 7-14 | — | — | O | O | 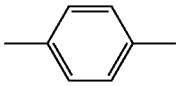 | H | 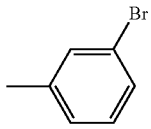 | H | 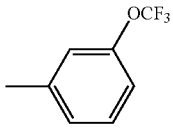 |
| 7-15 | — | — | O | O | 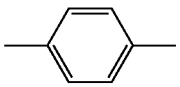 | H | 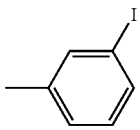 | H | 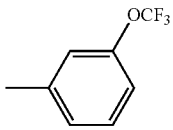 |
TABLE 8
Case of $n_1 = 1$, $n_2 = n_3 = 0$ in Basic Pattern II
| Exemplary Compound | R1 | R2 | Z1 | Z2 | A1 | R3 | R4 | R5 | R6 |
|---|---|---|---|---|---|---|---|---|---|
| 8-1 | — | — | O | O | 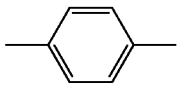 | H | 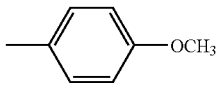 | H | 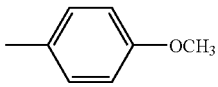 |

TABLE 8-continued
Case of $n_1 = 1$, $n_2 = n_3 = 0$ in Basic Pattern II
| Exemplary Compound | R1 | R2 | Z1 | Z2 | A1 | R3 | R4 | R5 | R6 |
|---|---|---|---|---|---|---|---|---|---|
| 8-2 | — | — | O | O | 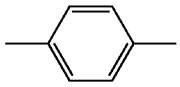 | H | 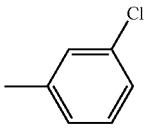 | H | 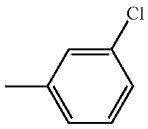 |
| 8-3 | — | — | O | O | 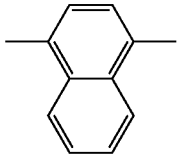 | H | 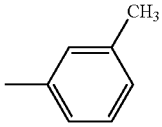 | H | 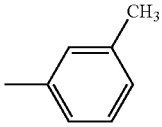 |
| 8-4 | — | — | O | O | 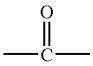 | H | 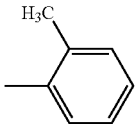 | H | 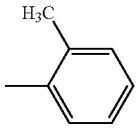 |
| 8-5 | — | — | O | O | 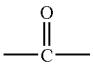 | H | 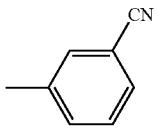 | H | 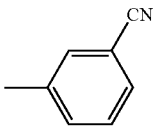 |
| 8-6 | Cl | Cl | O | O | 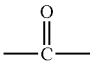 | H | 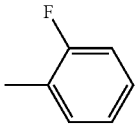 | H | 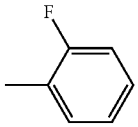 |
| 8-7 | — | — | O | O | 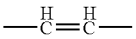 | H | 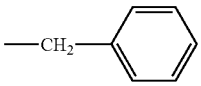 | H | 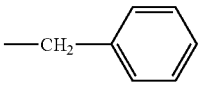 |
| 8-8 | — | — | S | S | 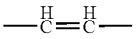 | H | 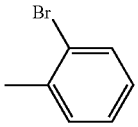 | H | 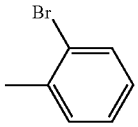 |
| 8-9 | Cl | Cl | O | O | 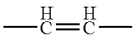 | H | 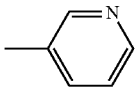 | H | 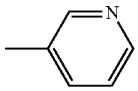 |
| 8-10 | — | — | O | O | —CH2— | H | 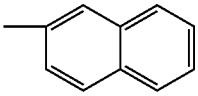 | H | 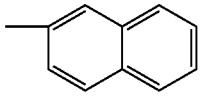 |
TABLE 9
Case of $n_1 = 1$ $n_2 = n_3 = 0$ in Basic Pattern III
| Exemplary Compound | R1 | R2 | Z1 | Z2 | A1 | R3 | R4 | R5 | R6 |
|---|---|---|---|---|---|---|---|---|---|
| 9-1 | — | — | O | O | 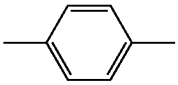 | H | 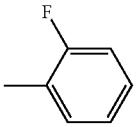 | H | 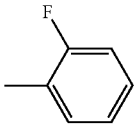 |

TABLE 9-continued
| Exemplary Compound | R1 | R2 | Z1 | Z2 | A1 | R3 | R4 | R5 | R6 |
|---|---|---|---|---|---|---|---|---|---|
| | | | | | Case of $n_1 = 1$ $n_2 = n_3 = 0$ in Basic Pattern III | | | | |
| 9-2 | — | — | O | O | 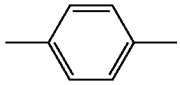 | H | 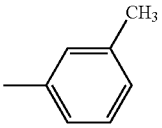 | H | 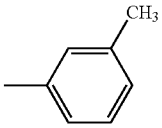 |
| 9-3 | — | — | O | O | 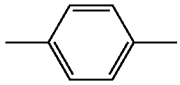 | H | 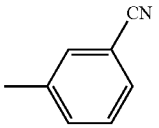 | H | 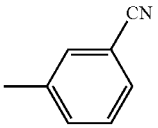 |
| 9-4 | — | — | O | O | 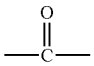 | H | 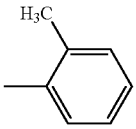 | H | 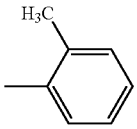 |
| 9-5 | — | — | O | O | 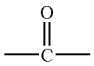 | H | 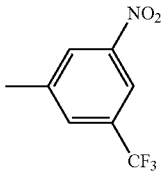 | H | 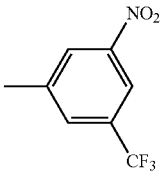 |
| 9-6 | — | — | O | O | 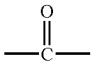 | H | 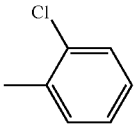 | H | 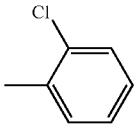 |
| 9-7 | CH3 | CH3 | O | O | 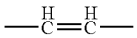 | H | 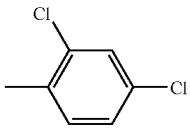 | H | 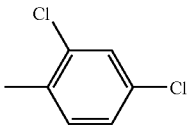 |
| 9-8 | — | — | O | O | 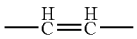 | H | 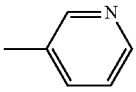 | H | 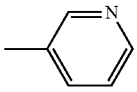 |
| 9-9 | — | — | O | O | 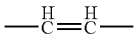 | H | 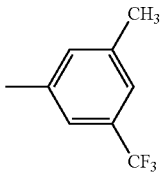 | H | 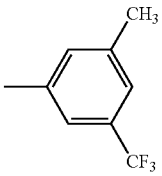 |
| 9-10 | — | — | O | O | —CH2— | H | 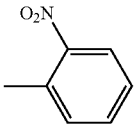 | H | 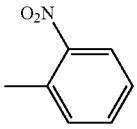 |

TABLE 10
Case of $n_1 = n_2 = 1$, $n_3 = 0$ in Basic Pattern I
| Exemplary Compound | R1 | R2 | Z1 | Z2 | A1 | A2 | R3 | R4 | R5 | R6 |
|---|---|---|---|---|---|---|---|---|---|---|
| 10-1 | — | — | O | O | 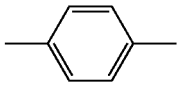 | 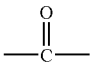 | H | 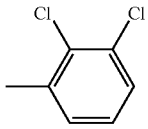 | H | 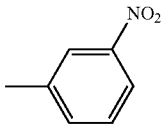 |
| 10-2 | — | — | O | O | 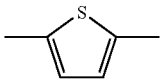 | 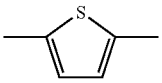 | H | 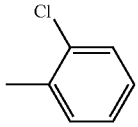 | H | 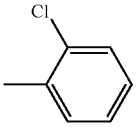 |
| 10-3 | — | — | O | O | 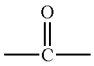 | 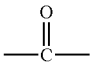 | H | 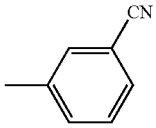 | H | 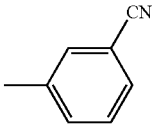 |
| 10-4 | — | — | O | O | —CH2— | 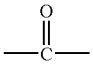 | H | 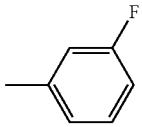 | H | 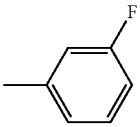 |
| 10-5 | — | — | O | O | 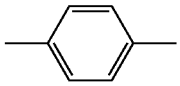 | 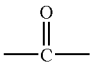 | H | 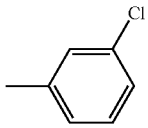 | H | 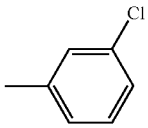 |
| 10-6 | — | — | O | O | 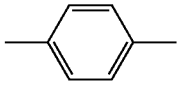 | 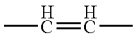 | H | 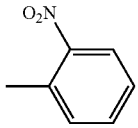 | H | 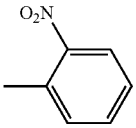 |
| 10-7 | — | — | O | O | 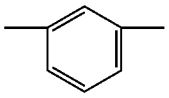 | 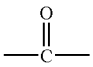 | H | 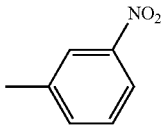 | H | 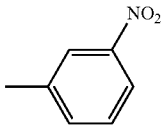 |
| 10-8 | — | — | O | O | 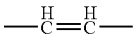 | 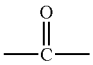 | H | 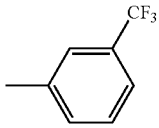 | H | 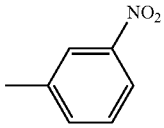 |
| 10-9 | — | — | O | O | 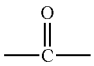 | 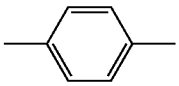 | H | 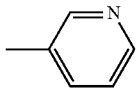 | H | 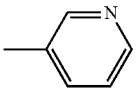 |
| 10-10 | — | — | O | O | 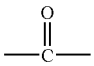 | —CH2— | H | 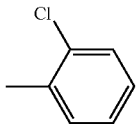 | H | 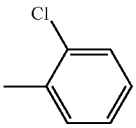 |
| 10-11 | — | — | O | O | 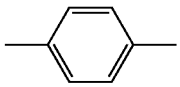 | 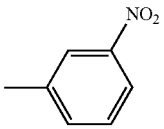 | H | 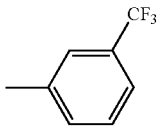 | H | 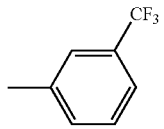 |

TABLE 10-continued
Case of $n_1 = n_2 = 1$, $n_3 = 0$ in Basic Pattern I
| Exemplary Compound | R1 | R2 | Z1 | Z2 | A1 | A2 | R3 | R4 | R5 | R6 |
|---|---|---|---|---|---|---|---|---|---|---|
| 10-12 | — | — | O | O | 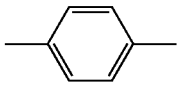 | 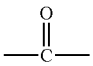 | H | 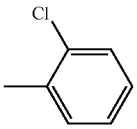 | H | 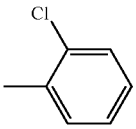 |
| 10-13 | — | — | O | O | 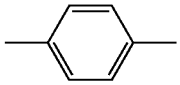 | 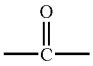 | H | 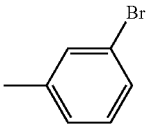 | H | 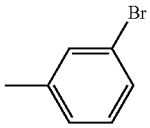 |
| 10-14 | — | — | O | O | 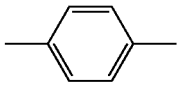 | 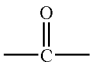 | H | 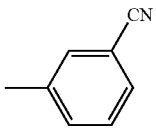 | H | 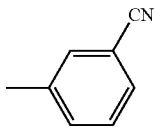 |
| 10-15 | — | — | O | O | 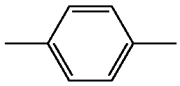 | 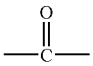 | H | 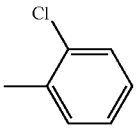 | H | 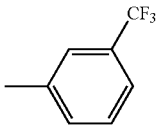 |
TABLE 11
Case of $n_1 = n_2 = 1$, $n_3 = 0$ in Basic Pattern II
| Exemplary Compound | R1 | R2 | Z1 | Z2 | A1 | A2 | R3 | R4 | R5 | R6 |
|---|---|---|---|---|---|---|---|---|---|---|
| 11-1 | — | — | O | O | 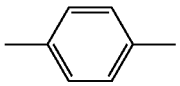 | 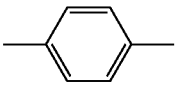 | H | 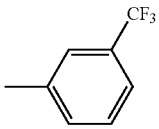 | H | 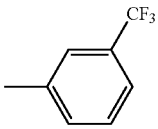 |
| 11-2 | — | — | O | O | —CH2— | —CH2— | H | 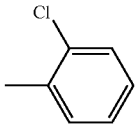 | H | 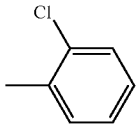 |
| 11-3 | — | — | O | O | —CH2— | 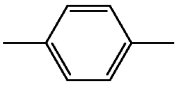 | H | 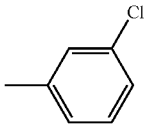 | H | 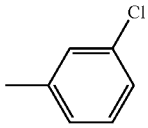 |
| 11-4 | — | — | O | O | 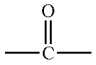 | 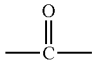 | H | 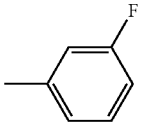 | H | 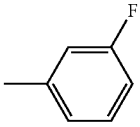 |
| 11-5 | — | — | O | O | 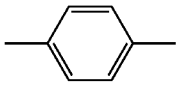 | 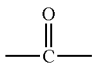 | H | 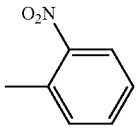 | H | 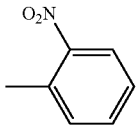 |

TABLE 11-continued
Case of $n_1 = n_2 = 1$, $n_3 = 0$ in Basic Pattern II
| Exemplary Compound | R1 | R2 | Z1 | Z2 | A1 | A2 | R3 | R4 | R5 | R6 |
|---|---|---|---|---|---|---|---|---|---|---|
| 11-6 | — | — | O | O | 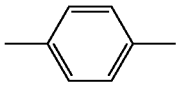 | 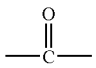 | H | 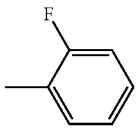 | H | 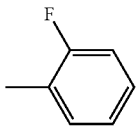 |
| 11-7 | — | — | O | O | 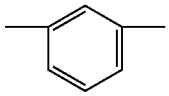 | 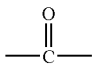 | H | 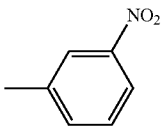 | H | 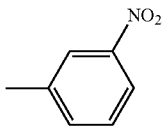 |
| 11-8 | — | — | O | O | 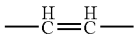 | 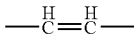 | H | 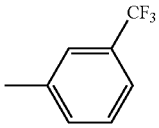 | H | 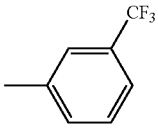 |
| 11-9 | — | — | O | O | 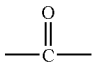 | 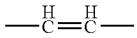 | H | 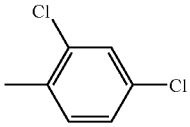 | H | 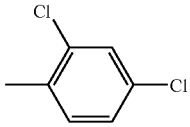 |
| 11-10 | — | — | O | O | 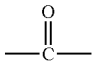 | 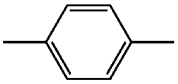 | H | 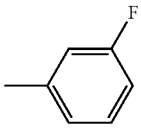 | H | 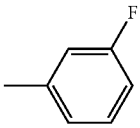 |
TABLE 12
Case of $n_1 = n_2 = 1$, $n_3 = 0$ in Basic Pattern III
| Exemplary Compound | R1 | R2 | Z1 | Z2 | A1 | A2 | R3 | R4 | R5 | R6 |
|---|---|---|---|---|---|---|---|---|---|---|
| 12-1 | — | — | O | O | 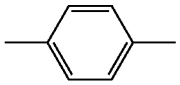 | 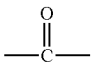 | H | 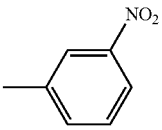 | H | 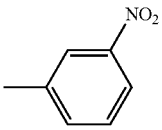 |
| 12-2 | — | — | O | O | 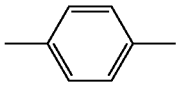 | 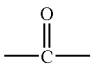 | H | 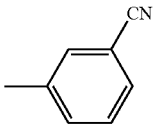 | H | 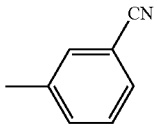 |
| 12-3 | — | — | O | O | 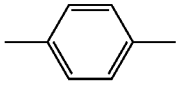 | 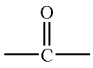 | H | 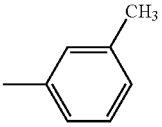 | H | 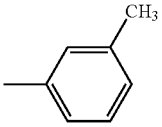 |
| 12-4 | — | — | O | O | 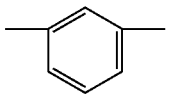 | 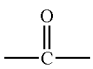 | H | 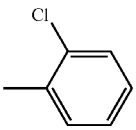 | H | 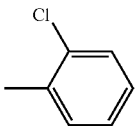 |

TABLE 12-continued
| Case of $n_1 = n_2 = 1$, $n_3 = 0$ in Basic Pattern III | | | | | | | | | | |
|---|---|---|---|---|---|---|---|---|---|---|
| Exemplary Compound | R1 | R2 | Z1 | Z2 | A1 | A2 | R3 | R4 | R5 | R6 |
| 12-5 | — | — | O | O | 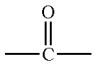 | 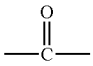 | H | 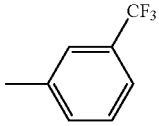 | H | 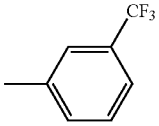 |
TABLE 13
| Case of $n_1 = n_2 = n_3 = 1$ in Basic Pattern I | | | | | | |
|---|---|---|---|---|---|---|
| Exemplary Compound | R1 | R2 | Z1 | Z2 | A1 | A2 |
| 13-1 | — | — | O | O | 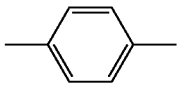 | 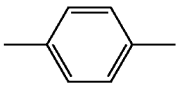 |
| 13-2 | — | — | O | O | 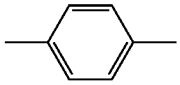 | 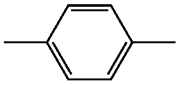 |
| 13-3 | — | — | O | O | 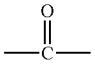 | 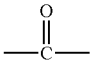 |
| 13-4 | — | — | O | O | 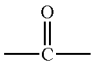 | 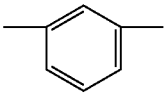 |
| 13-5 | — | — | O | O | 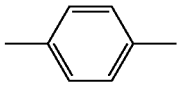 | 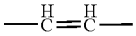 |
| Exemplary Compound | A3 | R3 | R4 | R5 | R6 |
|---|---|---|---|---|---|
| 13-1 | 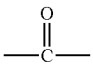 | H | 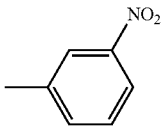 | H | 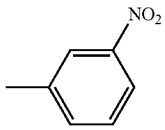 |
| 13-2 | 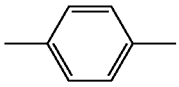 | H | 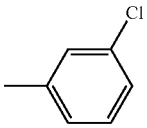 | H | 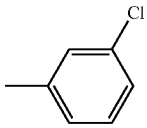 |
| 13-3 | 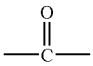 | H | 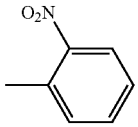 | H | 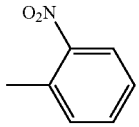 |
| 13-4 | 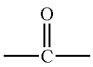 | H | 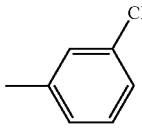 | H | 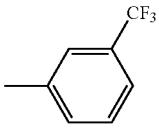 |

TABLE 13-continued
| Case of $n_1 = n_2 = n_3 = 1$ in Basic Pattern I | | | | | |
|---|---|---|---|---|---|
| 13-5 | 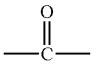 | H | 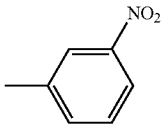 | H | 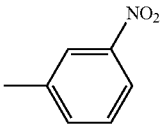 |
TABLE 14
| Case of $n_1 = n_2 = n_3 = 1$ in Basic Pattern II | | | | | | |
|---|---|---|---|---|---|---|
| Exemplary Compound | R1 | R2 | Z1 | Z2 | A1 | A2 |
| 14-1 | — | — | O | O | 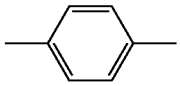 | 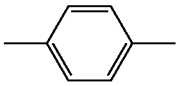 |
| 14-2 | — | — | O | O | 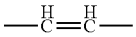 | 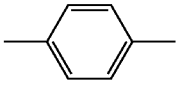 |
| 14-3 | — | — | O | O | 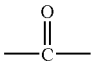 | 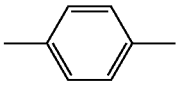 |
| 14-4 | — | — | O | O | 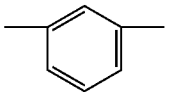 | 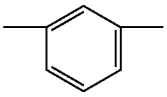 |
| 14-5 | — | — | O | O | 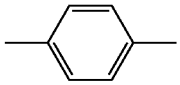 | —CH2— |
| Exemplary Compound | A3 | R3 | R4 | R5 | R6 |
|---|---|---|---|---|---|
| 14-1 | 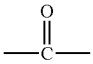 | H | 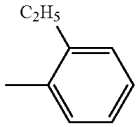 | H | 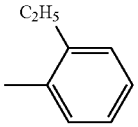 |
| 14-2 | 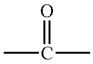 | H | 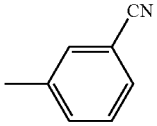 | H | 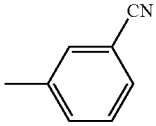 |
| 14-3 | 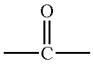 | H | 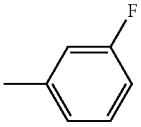 | H | 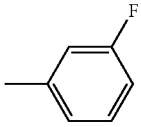 |
| 14-4 | 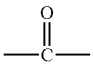 | H | 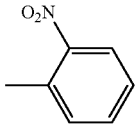 | H | 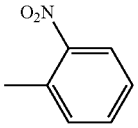 |

TABLE 14-continued

| Case of $n_1 = n_2 = n_3 = 1$ in Basic Pattern II | | | | | |
|---|---|---|---|---|---|
| 14-5 | 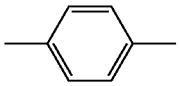 | H | 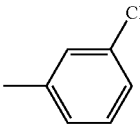 | $CF_3$ H | 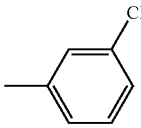 $CF_3$ |

Of the bisazo pigments according to the present invention which are shown in the above Tables 1 to 14, bisazo pigments of the following Exemplary Compound Numbers have especially superior sensitivity to the blue (purple) semiconductor laser light used as writing light for forming electrostatic latent images on the photosensitive member, and hence are those particularly preferably usable in the present invention.

Exemplary Compound Nos.:
1-8, 1-11, 1-12, 1-13, 1-14, 1-15;
2-2, 2-4, 2-9, 2-10, 2-11, 2-12, 2-13, 2-14;
3-4;
6-1, 6-4, 6-11, 6-12, 6-13, 6-14;
7-3, 7-5, 7-11, 7-12, 7-13; and
10-11.

Further, of the bisazo compounds of the above Exemplary Compound Numbers, bisazo compounds having symmetrical structures shown as Exemplary Compounds Nos. 1-11 and 2-4 and bisazo compounds having asymmetrical structures shown as Exemplary Compounds Nos. 1-12, 1-13, 1-14, 1-15, 2-9, 2-10, 2-11, 2-12, 2-13, 2-14 and 3-4 are those which afford photosensitive members having superior sensitivity also when white light is used as writing light.

The above bisazo pigment may be used in combination of two or more types. Also optionally usable in the form of a mixture with the above is a charge-generating material including cationic dyes such as pyrylium dyes, thiapyrylium dyes, azulenium dyes, thiacyanine dyes and quinocyanine dyes, squalium salt dyes, azo pigments other than the above bisazo pigment, polycyclic quinone pigments such as anthanthrone pigments, dibenzopyrenequinone pigments and pyranthrone pigments, indigo pigments, quinacridone pigments, perylene pigments and phthalocyanine pigments.

The binder resin used to form the charge generation layer may be selected from comprehensive insulating resins or organic photoconductive polymers. Preferred are polyvinyl butyral, polyvinyl benzal, polyarylates, polycarbonates, polyesters, phenoxy resins, cellulose resins, acrylic resins, and polyurethanes, as well as copolymers of two or more of these. These resins may have a substituent. As the substituent, preferred are a halogen atom, an alkyl group, an alkoxyl group, a nitro group, a cyano group, a trifluoromethyl group and so forth. The binder resin may also preferably be used in an amount of 80% by weight or less, and more preferably 60% by weight or less, based on the total weight of the charge generation layer.

The charge generation layer may be formed by coating a charge generation layer coating dispersion obtained by dispersing the charge-generating material together with the binder resin and a solvent, followed by drying. As a method for dispersion, a method is available which makes use of a homogenizer, ultrasonic waves, a ball mill, a sand mill, an attritor, a roll mill or the like. The charge-generating material and the binder resin may preferably be in a proportion ranging from 1:0.1 to 1:4 (weight ratio).

As the solvent used for the charge generation layer coating dispersion, it may be selected taking account of the binder resin to be used and the solubility or dispersion stability of the charge-generating material. It may include, e.g., ethers such as tetrahydrofuran, 1,4-dioxane and 1,2-dimethoxyethane, ketones such as cyclohexanone, methyl ethyl ketone and pentanone, amines such as N,N-dimethylformamide, esters such as methyl acetate and ethyl acetate, aromatics such as toluene, xylene and chlorobenzene, alcohols such as methanol, ethanol and 2-propanol, and aliphatic halogenated hydrocarbons such as chloroform, methylene chloride, dichloroethylene, carbon tetrachloride, and trichloroethylene.

When the charge generation layer coating solution is coated, coating methods as exemplified by dip coating, spray coating, spinner coating, roller coating, Mayer bar coating and blade coating may be used.

The charge generation layer may also preferably be in a layer thickness of 5 μm or less, and particularly more preferably from 0.1 μm to 2 μm.

To the charge generation layer, a sensitizer, an antioxidant, an ultraviolet absorber, a plasticizer, a thickening agent and so forth which may be of various types may also optionally be added.

A charge transport layer is provided on the charge generation layer.

The charge transport layer has the function to receive charged carriers from the charge generation layer in the presence of an electric field and transport the same. The charge transport layer may be formed by coating a coating solution prepared by dissolving a charge-transporting material in a solvent together with a binder resin, followed by drying. It may preferably be in a layer thickness of from 5 μm to 40 μm, more preferably from 5 μm to 30 μm, and still more preferably from 5 μm to 20 μm.

The charge-transporting material includes an electron-transporting material and a hole-transporting material.

The electron-transporting material may include, e.g., electron-attracting substances such as 2,4,7-trinitrofluorenone, 2,4,5,7-tetranitrofluorenone, chloranil and tetracyanoquinodimethane, and those obtained by polymerizing these electron-attracting substances.

The hole-transporting material may include, e.g., polycyclic aromatic compounds such as pyrene and anthracene, heterocyclic compounds such as carbazole compounds, indole compounds, oxazole compounds, thiazole compounds, oxadiazole compounds, pyrazole compounds, pyrazoline compounds, thiadiazole compounds and triazole compounds, hydrazone compounds, styryl compounds, benzidine compounds, triarylmethane compounds, and triphenylamine compounds.

Any of these charge-transporting materials may be used alone or in combination of two or more types.

Where the charge-transporting material has no film-forming properties, a suitable binder resin may be used. The binder resin used for the charge transport layer may include, e.g., insulating resins such as acrylic resins, polyarylates, polycarbonates, polyesters, polystyrene, an acrylonitrile-styrene copolymer, polyacrylamide, polyamide and chlorinated rubber, and organic photoconductive polymers such as poly-N-vinyl carbazole and polyvinyl anthracene. One or two or more of any of these may be used alone or in the form of a mixture or copolymer.

A photoconductive resin may also be used which functions as both the charge-transporting material and the binder resin, such as a polymer (e.g., poly-N-vinyl carbazole, polyvinyl anthracene) having in the backbone chain or side chain a group derived from the above charge-transporting material.

However, in the case when the photosensitive layer has the layer configuration as shown in FIG. 1 in which the charge generation layer and the charge transport layer are superposed on the support in this order and such one is used in the electrophotographic photosensitive member, it is necessary to select a charge-transporting material and a binder resin which have high transmittance in respect to the lasing wavelength of the semiconductor laser to be used.

As the solvent used in the charge transport layer coating solution, usable are ketones such as acetone and methyl ethyl ketone, ethers such as tetrahydrofuran and dimethoxymethane, esters such as methyl acetate and ethyl acetate, aromatic hydrocarbons such as toluene and xylene, and hydrocarbons substituted with a halogen atom, such as chlorobenzene, chloroform and carbon tetrachloride.

When the charge transport layer coating solution is coated, coating methods as exemplified by dip coating, spray coating, spinner coating, roller coating, Mayer bar coating and blade coating may be used.

To the charge transport layer, an antioxidant, an ultraviolet absorber, a plasticizer, a filler and so forth may also optionally be added.

In the case when the photosensitive layer is of a single-layer type, such a single-layer type photosensitive layer may be formed by coating a single-layer type photosensitive layer coating dispersion obtained by dispersing the charge-generating material and the charge-transporting material together with the binder resin and the solvent, followed by drying.

A protective layer may also be provided on the photosensitive layer, for the purpose of protecting the photosensitive layer from mechanical external force, chemical external force and so forth and also for the purpose of improving transfer performance and cleaning performance.

The protective layer may be formed by coating a protective layer coating solution obtained by dissolving a resin such as polyvinyl butyral, polyester, polycarbonate, polyamide, polyimide, polyarylate, polyurethane, a styrene-butadiene copolymer, a styrene-acrylic acid copolymer or a styrene-acrylonitrile copolymer in a solvent, followed by drying.

In order to make the protective layer have charge transport performance together, the protective layer may also be formed by curing a monomer material having charge transport performance, or a polymer type charge-transporting material, by cross-linking reaction of various types. The reaction by which it is cured may include radical polymerization, ion polymerization, thermal polymerization, photopolymerization, radiation polymerization (electron ray polymerization), plasma-assisted CVD and photo-assisted CVD.

The protective layer may further be incorporated with conductive particles, an ultraviolet absorbent, a wear resistance improver and so forth. As the conductive particles, metal oxides as exemplified by tin oxide particles are preferred. As the wear resistance improver, fine fluorine resin powders, alumina, silica and the like are preferred.

The protective layer may preferably be in a layer thickness of from 0.5 μm to 20 μm, and particularly preferably from 1 μm to 10 μm.

The surface layer of the organic photosensitive member is meant to be the charge transport layer in what is shown in FIG. 1, the charge generation layer in what is shown in FIG. 2, and the photosensitive layer in what is shown in FIG. 3.

Figure 4:
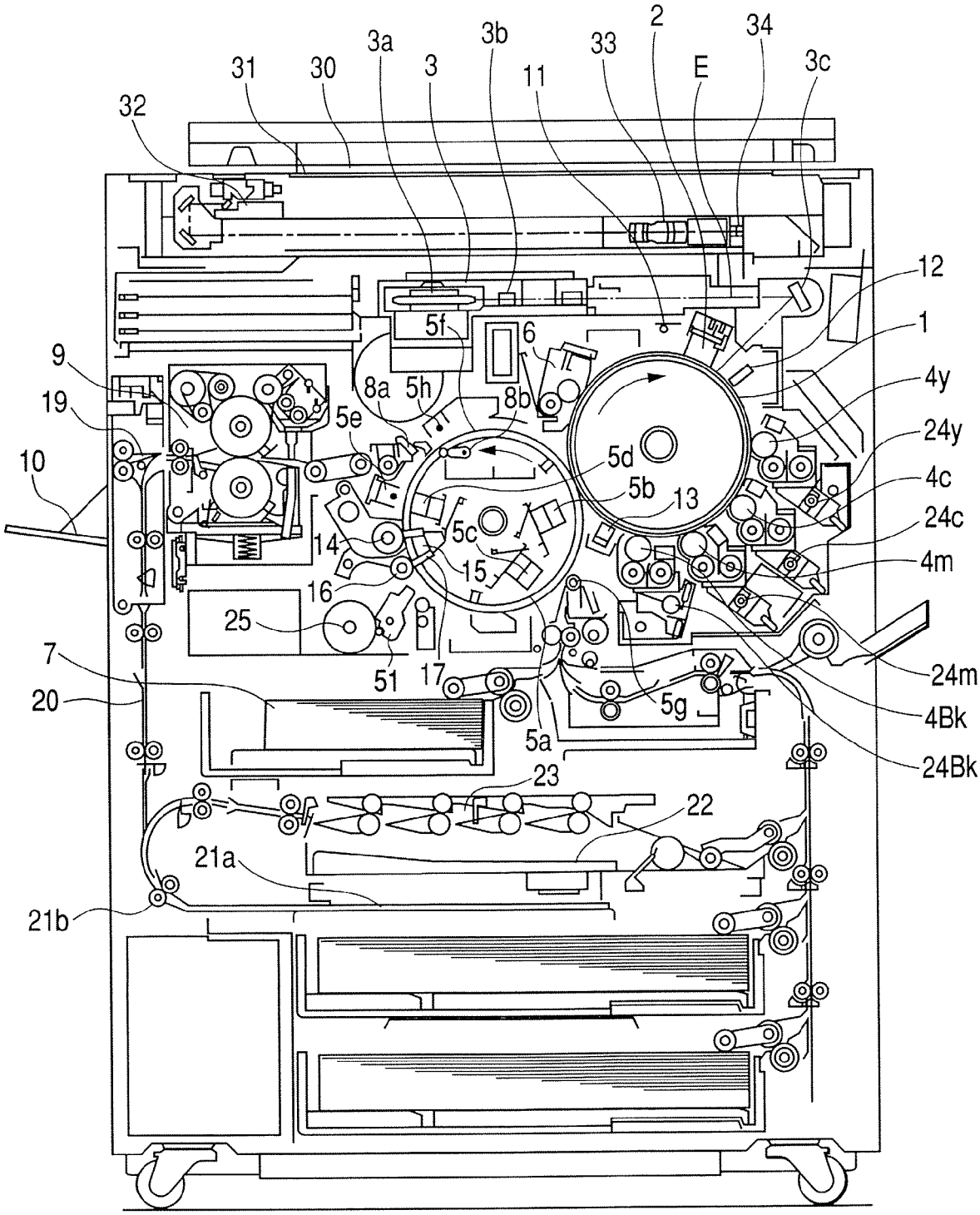
FIG. 4 is a schematic sectional view showing an example of an electrophotographic apparatus.

Next, an example of the electrophotographic apparatus having the electrophotographic photosensitive member of the present invention is shown in FIG. 4 as a schematic sectional view. What is shown in FIG. 4 is a full-color electrophotographic apparatus, which has a digital full-color-image reader section at the top and a digital full-color-image printer section at a lower part.

In the reader section, an original 30 is placed on an original-setting glass 31, and an exposure lamp 32 is put into exposure scanning, whereby an optical image reflected from the original 30 is focused on a full-color sensor 34 through a lens 33 to obtain full-color color separation image signals. The full-color color separation image signals are processed by a video processing unit (not shown) through an amplifying circuit (not shown), and then forwarded to the printer section.

In the printer section, reference numeral 1 denotes an electrophotographic photosensitive member, which is supported rotatably in the direction of an arrow. Around the electrophotographic photosensitive member 1, provided are a pre-exposure lamp 11 (destaticizing means), a corona charging assembly 2 (charging means), a laser exposure optical system 3 (exposure means), a potential sensor 12, different color, four developing assemblies 4*y*, 4*c*, 4*m* and 4Bk (developing means), a detecting means 13 for detecting the amount of light on the surface of the electrophotographic photosensitive member, a transfer means 5, and a cleaner 6 (cleaning means).

The laser exposure optical system 3 has the blue (purple) semiconductor laser. Its lasing wavelength may preferably be from 380 nm to 500 nm, and more preferably from 380 nm to 450 nm. As types of the laser, a ZnSe semiconductor laser and a GaN semiconductor laser are preferred. In particular, the GaN semiconductor laser is preferred. With regard to laser exposure output, it may preferably be 1 mW or more, more preferably 3 mW or more, and particularly preferably 5 mW or more.

In the laser exposure optical system 3, the image signals sent from the reader section are converted in a laser output section (not shown) into optical signals for image scanning exposure, and the laser beam thus converted is reflected on a polygonal mirror 3*a* and projected on the surface of the electrophotographic photosensitive member 1 through a lens 3*b* and a mirror 3*c*. Writing pitch is set to about 400 dpi to about 2,400 dpi; and the beam spot diameter, to about 15 μm to about 40 μm.

At the time of image formation in the printer section, the electrophotographic photosensitive member 1 is rotated in the direction of the arrow. The electrophotographic photosensitive member 1 is, after destaticized by the exposure lamp 11, uniformly negatively electrostatically charged by means of the charging assembly 2, and then irradiated with an optical image E for each separated color to form electrostatic latent images on the surface of the electrophotographic photosensitive member 1.

Next, a stated developing assembly is operated to develop the electrostatic latent images formed on the surface of the electrophotographic photosensitive member 1, to form developed images on the surface of the electrophotographic photosensitive member 1 by the use of a one-component developer (a toner) or two-component developer (each making use of a negative toner) composed of a resin as a base material. The developing assemblies are so set as to alternatively come close to the electrophotographic photosensitive member 1 in accordance with the respective separated colors by the operation of eccentric cams 24*y*, 24*c*, 24*m* and 24Bk.

Developed images held on the surface of the electrophotographic photosensitive member 1 are further transferred to a sheet of paper (transfer material) which has been fed from a transfer material cassette 7 in which sheets of paper which are transfer materials are kept held, through a transport system and a transfer means 5 and to the position facing the electrophotographic photosensitive member 1. The transfer means 5 has, in this example, a transfer drum 5*a*, a transfer charging assembly 5*b*, an attraction charging assembly 5*c* for attracting a sheet of paper (transfer material) electrostatically, an attraction roller 5*g* provided opposingly thereto, an inside charging assembly 5*d*, and an outside charging assembly 5*e*. The transfer drum 5*a*, which is axially supported so that it can rotatingly be driven, has a transfer material holding sheet 5*f* made of a dielectric material, which is stretched integrally in a cylindrical form at an open zone on the periphery thereof. As the transfer material holding sheet 5*f*, a dielectric-material sheet such as polycarbonate film is used.

As the transfer drum 5*a* is rotated, the developed images on the surface of the electrophotographic photosensitive member 1 are transferred by means of the transfer charging assembly 5*b* to the sheet of paper (transfer material) held on the transfer material holding sheet 5*f* of the transfer drum 5*a*.

In this way, a desired number of color images are transferred to the sheet of paper (transfer material) attracted to and transported on the transfer material holding sheet 5*f*, thus a full-color image is formed.

In the case when the full-color image is formed, the transfer of four-color developed images is thus completed, whereupon the sheet of paper (transfer material) is separated from the transfer drum 5*a* by the action of a separation claw 8*a*, a separation push-up roller 8*b* and a separation charging assembly 5*h*, and then put out to a tray 10 via a heat roller fixing assembly 9.

Meanwhile, the electrophotographic photosensitive member 1 after transfer is cleaned by removing with the cleaner 6 the toners remaining on the surface, and thereafter again put to the steps of image formation.

When the image is formed on the both sides of the sheet of paper (transfer material), immediately after the paper has been delivered out of the fixing assembly 9, a transport path switch guide 19 is driven to first guide the paper to a reverse path 21*a* via a transport vertical path 20, and then reverse rollers 21*b* are rotated in reverse so that the sheet of paper is withdrawn in the direction opposite to the direction in which it has been sent into the rollers, with its leading end first which had been the rear end when sent into the rollers,. and is received in an intermediate tray 22. Thereafter, an image is formed again on the other side through the image formation steps described above.

In order to, e.g., prevent powder from scattering and adhering onto the transfer material holding sheet 5*f* of the transfer drum 5*a* and prevent oil from adhering onto the paper (transfer material), cleaning is also performed by the action of a fur brush 14 and a back-up brush 15 set opposingly to the fur brush 14 via the transfer material holding sheet 5*f*, and an oil-removing roller 16 and a back-up brush 17 set opposingly to the oil-removing roller 16 via the transfer material holding sheet 5*f*. Such cleaning may be performed before the image formation or after the image formation, or may be performed at any time when a jam (paper jam) occurs.

In this example, an eccentric cam 25 is also operated at desired timing to actuate a cam follower 5*i* associated with the transfer drum 5*a*, whereby the gap between the transfer material holding sheet 5*f* and the electrophotographic photosensitive member 1 can be set as desired. For example, during a stand-by or at the time of power-off, a space is kept between the transfer drum 5*a* and the electrophotographic photosensitive member 1.

Figure 5:
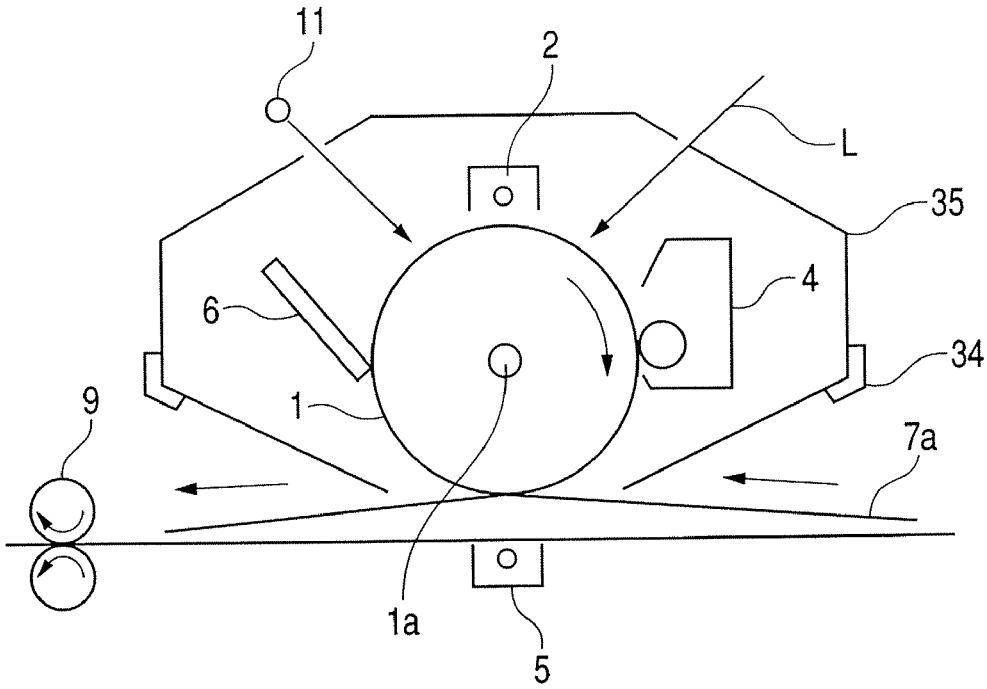
FIG. 5 is a schematic sectional view showing an example of an electrophotographic apparatus having a process cartridge.

Next, an example of a process cartridge having the electrophotographic photosensitive member of the present invention is shown in FIG. 5 as a schematic sectional view.

In the apparatus shown in FIG. 5, at least an electrophotographic photosensitive member 1, a corona charging assembly 2 and a developing means 4 are received in a container 35 to make up a process cartridge. The process cartridge is so constructed as to be detachably mountable to the main body of the apparatus by the use of a guide means 34 such as rails. The cleaning means 6 need not necessarily be provided in the container 35.

Figure 6:
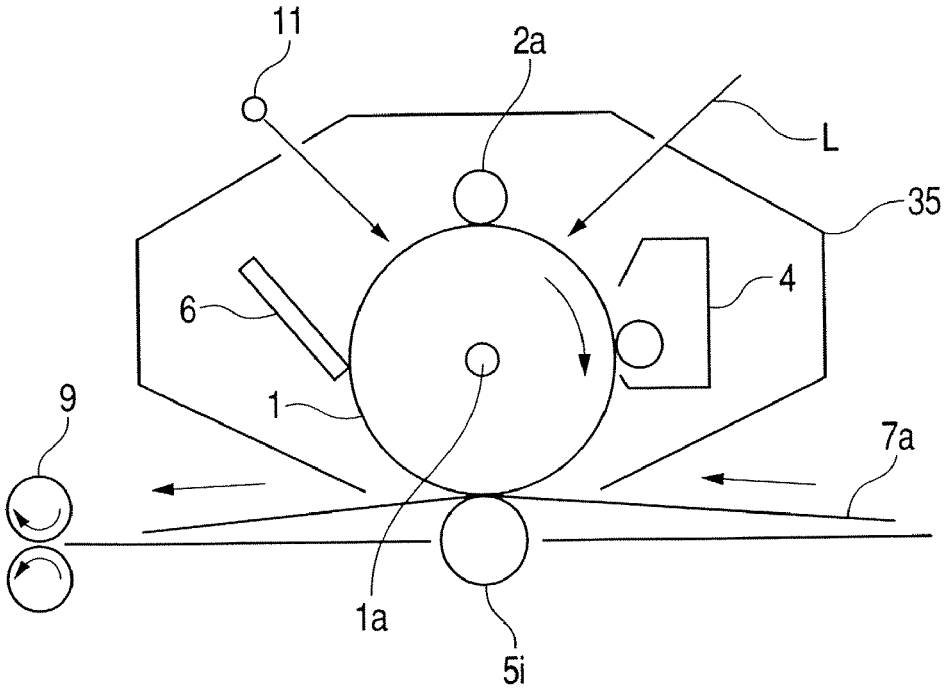
FIG. 6 is a schematic sectional view showing another example of an electrophotographic apparatus having a process cartridge.
Figure 7:
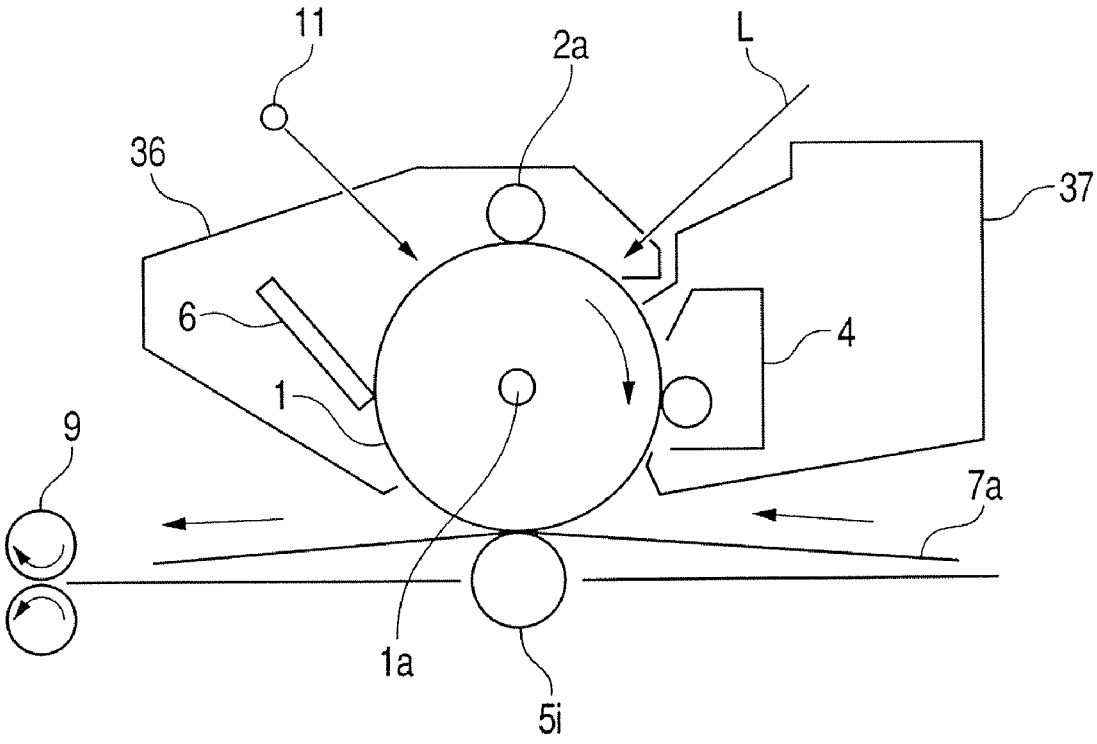
FIG. 7 is a schematic sectional view showing still another example of an electrophotographic apparatus having a process cartridge.

As also shown in FIGS. 6 and 7, a contact charging member 2*a* may be employed as the charging means, and the contact charging member 2*a*, to which a voltage is kept applied, may be brought into contact with the electrophotographic photosensitive member 1 to charge the electrophotographic photosensitive member electrostatically (hereinafter, this charging system is called contact charging). In the apparatus shown in FIGS. 6 and 7, the toner image held on the electrophotographic photosensitive member is transferred also by a contact transfer means 5*i* to a transfer material 7*a*. More specifically, the contact transfer means 5*i*, to which a voltage is kept applied, is brought into contact with the transfer material 7*a* to transfer to the transfer material 7*a* the toner image held on the electrophotographic photosensitive member.

In addition, in the apparatus shown in FIG. 7, at least the electrophotographic photosensitive member 1 and the contact charging member 2*a* are received in a first container 36 to make up a first process cartridge, and at least the developing means 4 is received in a second container 37 to make up a second process cartridge. These first process cartridge and second process cartridge are so constructed as to be detachably mountable to the main body of the apparatus. The cleaning means 6 need not necessarily be provided.

A developer (toner) used in the electrophotographic apparatus having the electrophotographic photosensitive member of the present invention is described next.

The toner used in the present invention may preferably have a specific particle size distribution. If toner particles of 5 μm or less in particle diameter are less than 17% by number, the toner tends to be consumed in a large quantity. In addition, if the toner has a volume-average particle diameter Dv (μm) of 8 μm or more and a weight-average particle diameter D4 (μm) of 9 μm or more, the resolution of dots of 100 μm or less in diameter tends to lower, and this tendency is more remarkable in regard to the resolution of dots of 15 to 40 μm that is achievable in the present invention. In such a case, even if it is attempted to perform development according to unnatural designing under different development conditions, it is difficult to achieve stable developing performance, such that thick-line images or toner scatter tends to occur or the toner may be consumed in a large quantity.

If on the other hand toner particles of 5 μm or less in particle diameter are more than 90% by number, it may be difficult to perform development stably, to cause a difficulty such that the image density decreases. In order to more improve resolution, the toner may preferably be a toner having fine particle diameter of $3.0\ \mu m \leqq Dv \leqq 6.0\ \mu m$ and $3.5\ \mu m \leqq D4 \leqq 6.5\ \mu m$, which may further preferably be $3.2\ \mu m \leqq Dv \leqq 5.8\ \mu m$ and $3.6\ \mu m \leqq D4 \leqq 6.3\ \mu m$.

As a binder resin used in the toner, it may include styrene homopolymers or copolymers such as polystyrene, a styrene-acrylate copolymer, a styrene-methacrylate copolymer and a styrene-butadiene copolymer, polyester resins, epoxy resins, and petroleum resins.

In view of an improvement in releasability from a fixing member and an improvement in fixing performance at the time of fixing, it is preferable to incorporate in the toner such a wax as shown below. The wax may include paraffin wax and derivatives thereof, microcrystalline wax and derivatives thereof, Fischer-Tropsch wax and derivatives thereof, polyolefin wax and derivatives thereof, and carnauba wax and derivatives thereof. The derivatives include oxides, block copolymers with vinyl monomers, and graft modified products. Besides, also usable are long-chain alcohols, long-chain fatty acids, acid amide compounds, ester compounds, ketone compounds, hardened caster oil and derivatives thereof, vegetable waxes, animal waxes, mineral waxes and petrolatums.

As a colorant used in the toner, an inorganic pigment, an organic dye and an organic pigment which are conventionally known may be used. It may include, e.g., carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may usually be used in an amount of from 0.5 to 20 parts by weight based on 100 parts by weight of the binder resin.

A magnetic material may also be used as a component constituting the toner. The magnetic material may include magnetic metal oxides containing an element such as iron, cobalt, nickel, copper, magnesium, manganese, aluminum or silicon. Of these, those composed chiefly of a magnetic iron oxide such as triiron tetraoxide and γ-iron oxide are preferred.

For the purpose of charge control of the toner, also usable are a Nigrosine dye, a quaternary ammonium salt, a salicylic acid metal complex, a salicylic acid metal salt, a salicylic acid derivative metal complex, salicylic acid, acetylacetone and the like.

The toner used in the electrophotographic apparatus having the electrophotographic photosensitive member of the present invention may preferably have an inorganic fine powder on toner particle surfaces. This is effective for improving development efficiency, reproducibility of electrostatic latent images, and transfer efficiency, and making fog less occur.

The inorganic fine powder may include, e.g., fine powders formed of colloidal silica, titanium oxide, iron oxide, aluminum oxide, magnesium oxide, calcium titanate, barium titanate, strontium titanate, magnesium titanate, cerium oxide, zirconium oxide or the like. One or two or more of any of these may be used alone or in the form of a mixture. Of these, fine powders of oxides such as titania, alumina and silica or double oxides are preferred.

Such inorganic fine powder may also preferably be one having been subjected to hydrophobic treatment. In particular, the inorganic fine powder may preferably be one having been subjected to surface treatment with a silane coupling agent or a silicone oil. As methods for such hydrophobic treatment, available are a method in which the inorganic fine powder is treated with an organometallic compound such as a silane coupling agent or a titanium coupling agent, capable of reacting with or physically adsorptive to the former, and a method in which the inorganic fine powder is treated with an organosilicon compound such as silicone oil after it has been treated with a silane coupling agent or while it is treated with a silane coupling agent.

The inorganic fine powder may preferably be one having a BET specific surface area of 30 $m^2/g$ or more, and particularly within the range of from 50 to 400 $m^2/g$, according to nitrogen adsorption as measured by the BET method.

The inorganic fine powder having been hydrophobic-treated may preferably be used in an amount of from 0.01 to 8 parts by weight, more preferably from 0.1 to 5 parts by weight, and particularly still more preferably from 0.2 to 3 parts by weight, based on 100 parts by weight of toner particles.

To the toner, other additives may further be added so long as they substantially do not adversely affect the toner. They may include, e.g., lubricant powders such as polytetrafluoroethylene powder, zinc stearate powder and polyvinylidene fluoride powder; abrasives such as cerium oxide powder, silicon carbide powder and strontium titanate powder; fluidity-providing agents such as titanium oxide powder and aluminum oxide powder; anti-caking agents; conductivity-providing agents such as carbon black powder, zinc oxide powder and tin oxide powder; and developing performance improvers such as organic fine particles and inorganic fine particles with polarity reverse to that of the toner.

To produce the toner, known methods may be used. For example, the binder resin, the wax, the metal salt or metal complex, the pigment, dye or magnetic material as a colorant, and optionally the charge control agent and other additives are thoroughly mixed by means of a mixing machine such as Henschel mixer or a ball mill, and then the mixture obtained is melt-kneaded by means of a heat kneading machine such as a heat roll, a kneader or an extruder to make the resin and so forth melt one another, in which the metal compound and the pigment, dye or magnetic material are made to disperse or dissolve, followed by cooling for solidification and thereafter pulverization and strict classification. Thus, the toner can be obtained. In the step of classification, a multi-division classifier may preferably be used in view of production efficiency.

The toner may also be produced by a method in which a polymerizable monomer, the colorant and so forth are suspended in an aqueous medium and polymerization is carry out to produce toner particles directly, or a method in which fine polymer particles obtained by emulsion polymerization or the like are dispersed in an aqueous medium to make them undergo association and fusing together with the colorant.

In addition, the toner may be used as a magnetic one-component developer or a non-magnetic one-component developer, or may be blended with carrier particles so as to be used as a two-component developer.

As a developing system in the electrophotographic apparatus having the electrophotographic photosensitive member of the present invention, a system is preferred in which a developer containing the toner comes into contact with the surface of the electrophotographic photosensitive member to perform reversal development. Where a magnetic-brush developing method making use of the toner and a magnetic carrier is used, used as the magnetic carrier is, e.g., magnetic ferrite, magnetite or iron powder, or those obtained by coating these with a resin such as an acrylic resin, a silicone resin or a fluorine resin.

According to the present invention, an electrophotographic photosensitive member is provided which has a high spectral sensitivity for the blue (purple) semiconductor laser light source, may less cause running potential variations throughout its running and can form stable images with high resolution.

According to the present invention, an electrophotographic photosensitive member is also provided which has a high sensitivity for white light sources as well, such as a halogen lamp.

According to the present invention, an electrophotographic apparatus and a process cartridge usable therein are further provided which can stably provide high-grade electrophotographic images in virtue of the use of the electrophotographic photosensitive member described above.

EXAMPLES

The present invention is described below in greater detail by giving Examples, which, however, by no means limit the present invention.

Synthesis Example 1

Synthesis of Exemplary Compound 6-2

1,500 ml of ion-exchanged water (conductivity: $1\times10^{-4}$ S/m; the same applies hereinafter), 45.6 ml (0.50 mol) of concentrated hydrochloric acid and 18 g (0.062 mol) of 4,4'-diaminobenzoylbiphenyl were put into a 3-liter beaker, and these were cooled to 0° C. A solution prepared by dissolving 9.045 g (0.13 mol) of sodium nitrite in 22.5 ml of ion-exchanged water was dropwise added to the solution over a period of 26 minutes while it was maintained to a liquid temperature of −1 to 3° C. Then, after the resultant mixture was stirred at a liquid temperature of 0 to 5° C. for 60 minutes, 1.5 g of activated carbon was added thereto, and these were stirred for 5 minutes, followed by suction filtration. The filtrate thus obtained was kept at a liquid temperature of 0 to 5° C., in the state of which a solution prepared by dissolving 23.993 g (0.22 mol) of sodium borofluoride in 80 ml of ion-exchanged water was dropwise added thereto over a period of 17 minutes with stirring, and thereafter these were stirred for 40 minutes. The crystals thus precipitated were subjected to suction filtration. Next, the filtration product obtained was dispersedly washed for 40 minutes with 600 ml of an aqueous 5% sodium borofluoride solution as it was kept at a liquid temperature of 0 to 5° C., followed by suction filtration. The filtration product obtained was further dispersedly washed for 40 minutes with a mixed solvent of 450 ml of acetonitrile and 1,000 ml of isopropyl ether as it was kept at a liquid temperature of 0 to 5° C., followed by suction filtration. After washing twice with a mixed solvent of 200 ml of acetonitrile and 500 ml of isopropyl ether through a filter, the filtration product was dried under reduced pressure at room temperature to obtain a borofluoride (yield: 22.63 g, 74.6%; decomposition point: 125.5° C.).

Next, 100 ml of N,N-dimethylformamide was put into a 300-ml beaker, and 2.43 g (0.0065 mol) of a compound having the following structural formula (15) was dissolved therein, followed by cooling to a liquid temperature of 0° C. Thereafter, 1.5 g (0.0031 mol) of the borofluoride obtained in the above step was added thereto, and then, after these were stirred for 1 minute, 0.72 g (0.0071 mol) of N-methylmorpholine was dropwise added over a period of 3 minutes. Thereafter, these were stirred for 2 hours at a liquid temperature of 0 to 5° C., and further stirred for 1 hour at room temperature, followed by suction filtration. Washing with 200 ml of N,N-dimethylformamide was carried out twice through a filter. The filtration product taken out was dispersedly washed for 2 hours with 150 ml of N,N-dimethylformamide four times, and was further dispersedly washed for 2 hours with 200 ml of ion-exhanged water four times, followed by freeze-drying to obtain Exemplary Compound 6-2 (yield: 2.32 g, 70.9%) Incidentally, the foregoing production steps were all carried out under yellow light. Formula (15)

Formula (15)

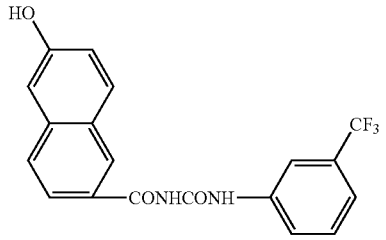

Example 1

An electrophotographic photosensitive member was produced in the following way. In the following, "part(s)" refers to "part(s) by weight".

50 parts of conductive titanium oxide particles coated with tin oxide containing 10% of antimony oxide, 25 parts of phenol resin, 20 parts of methyl cellosolve, 5 parts of methanol and 0.002 part of silicone oil (polydimethylsiloxane-polyoxyalkylene copolymer; number-average molecular weight: 3,000) were subjected to dispersion for 2 hours by means of a sand mill making use of glass beads of 0.8 mm in diameter, to prepare a conductive layer coating dispersion.

The above conductive layer coating dispersion was dip-coated on an aluminum crude pipe (ED pipe) (available from Showa Denko K.K.; 30 mm in diameter×357.5 mm in length; Rz jis: 0.8 μm), followed by drying at 140° C. for 30 minutes to form a conductive layer with a layer thickness of 15 μm.

Next, an intermediate layer coating solution prepared by dissolving 30 parts of methoxymethylated nylon resin (number-average molecular weight: 32,000) and 10 parts of an alcohol-soluble copolymer nylon resin (number-average molecular weight: 29,000) in a mixed solvent of 260 parts of methanol and 40 parts of butanol was dip-coated on the conductive layer, followed by drying at 100° C. for 10 minutes to form an intermediate layer with a layer thickness of 0.4 μm.

Next, 10 parts of the bisazo pigment (Exemplary Compound 6-2) obtained in Synthesis Example 1 was added to 215 parts of cyclohexanone, and then pre-dispersed at 20° C. for 20 hours by means of a sand mill making use of glass beads of 0.8 mm in diameter. Further, a solution prepared by dissolving 5 parts of poly(vinyl acetate-co-vinyl alcohol-co-vinylbenzal) (degree of benzalation: 80 mol %; weight-average molecular weight: 83,000) in 45 parts of cyclohexanone was added, and these were dispersed at 20° C. for 2 hours by means of the sand mill, followed by addition of 325 parts of methyl ethyl ketone to effect dilution to prepare a charge generation layer coating dispersion. This coating dispersion was dip-coated on the intermediate layer, followed by drying at 80° C. for 10 minutes to form a charge generation layer with a layer thickness of 0.30 μm.

Next, 7 parts of a charge-transporting material (A) having a structure represented by the following formula:

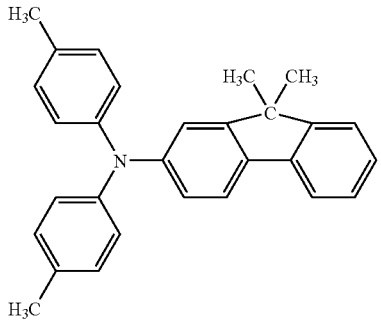

and 10 parts of polycarbonate resin (trade name: IUPILON Z-200; available from Mitsubishi Engineering Plastics Co.) were dissolved in a mixed solvent of 70 parts of monochlorobenzene and 5 parts of methylal to prepare a charge transport layer coating solution, which was then dip-coated on the charge generation layer, followed by drying at 120° C. for 1 hour to form a charge transport layer with a layer thickness of 12 μm.

Next; 3 parts of fine polytetrafluoroethylene resin powder (trade name: LUBRON L-2; available from Daikin Industries, Ltd.), 6 parts of polycarbonate resin (trade name: IUPILON Z-800 available from Mitsubishi Engineering Plastics Co.), 0.24 part of comb fluorine type graft polymer (trade name: GF300; available from Toagosei Chemical Industry Co., Ltd.), 120 parts of monochlorobenzene and 80 parts of methylal were subjected to dispersion mixing by means of an ultra-high pressure dispersion machine. To the dispersion obtained, 3 parts of the charge-transporting material (A) as shown above was added and mixed to dissolve it. The resultant dispersion (protective layer coating dispersion) was spray-coated on the charge transport layer, followed by drying at 80° C. for 10 minutes, and then drying at 120° C. for 50 minutes. Thereafter, the surface was polished for 1 minute with use of a polishing sheet (lapping tape; abrasive particles: alumina; abrasive particle diameter: #3000; available from Fuji Photo Film Co., Ltd.) to form a protective layer with a layer thickness of 3 μm and a ten-point average roughness Rz jis of 0.7 μm to obtain an electrophotographic photosensitive member.

Next, to this electrophotographic photosensitive member, gear and flanges were fitted, and this photosensitive member with gear and franges was set in a monochrome copying machine (GP-215, manufactured by CANON INC.). To a laser exposure optical system of its exposure means, a GaN chip (manufactured by Nichia Kagaku Kogyo K.K.) was mounted, having a lasing wavelength of 403 nm and an output of 5 mW, and the system was so altered as to have a beam spot of 28 μm. The amount of light at a light-area potential (Vl) of −200 V when set to a charge potential (Vd) of −700 V in an environment of 23° C./55% RH was regarded as sensitivity Δ500 ($V \cdot cm^2/\mu J$) to make measurement. As the result, it was 560 ($V \cdot cm^2/\mu J$). Thus, an electrophotographic photosensitive member having a very high sensitivity was obtained.

Examples 2 to 27

The sensitivity Δ500 ($V \cdot cm^2/\mu J$) was measured in the same manner as in Example 1 except that the bisazo pigment in the electrophotographic photosensitive member used in Example 1 was respectively changed for Exemplary Compounds shown in Table 15. As the result, it was ascertained that electrophotographic photosensitive members were obtained each having a very high sensitivity as shown in Table 15.

Comparative Examples 1 to 6

The sensitivity Δ500 ($V \cdot cm^2/\mu J$) was measured in the same manner as in Example 1 except that the bisazo pigment in the electrophotographic photosensitive member used in Example 1 was respectively changed for Comparative Bisazo Pigments (A) to (F) having structures represented by the following formulas. As the result, it was ascertained that only electrophotographic photosensitive members were obtained each having a low sensitivity as shown in Table 15.

Comparative Bisazo Pigment (A)

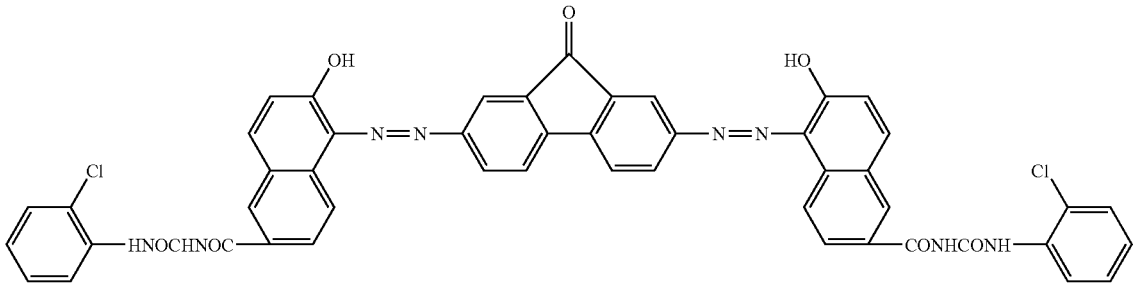

Comparative Bisazo Pigment (B)

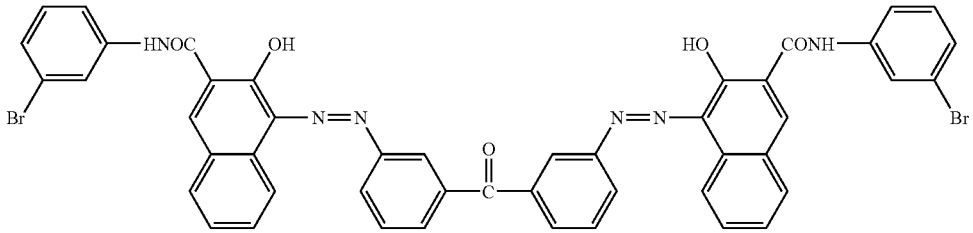

Comparative Bisazo Pigment (C)

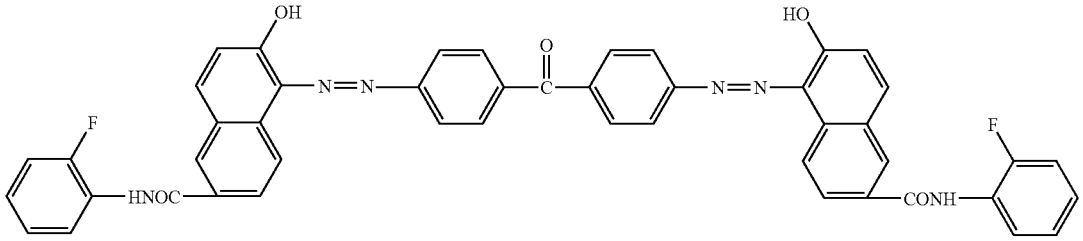

-continued

Comparative Bisazo Pigment (D)

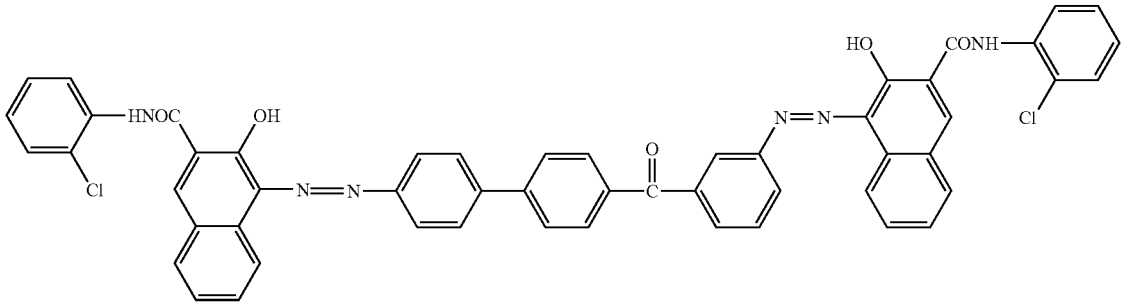

Comparative Bisazo Pigment (E)

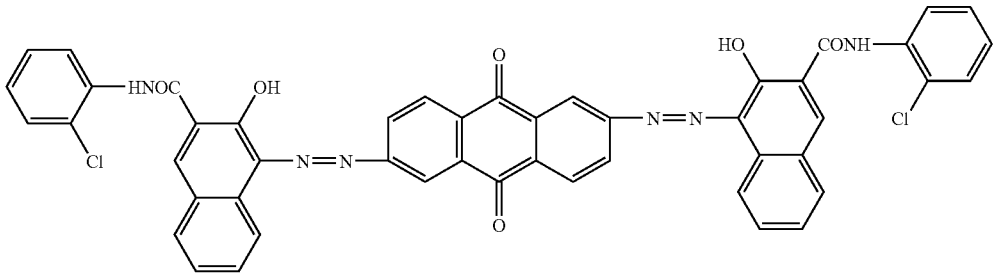

Comparative Bisazo Pigment (F)

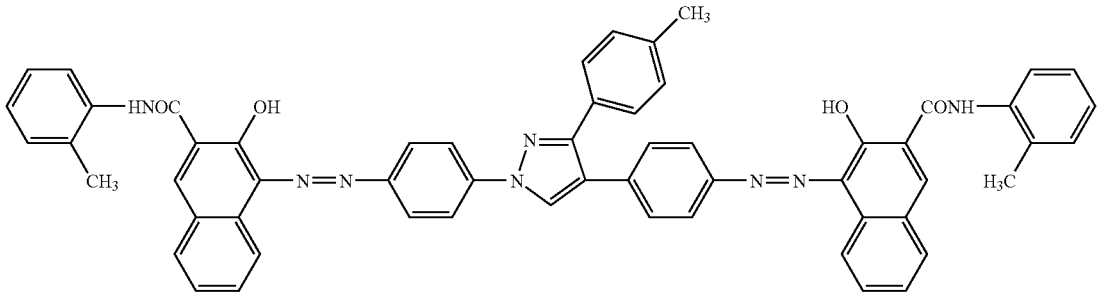

TABLE 15

| | Exemplary Compound | Δ500 (V · cm²/μJ) |
|---|---|---|
| Example: | | |
| 2 | 1-1 | 360 |
| 3 | 1-8 | 760 |
| 4 | 2-10 | 1,000 |
| 5 | 4-7 | 400 |
| 6 | 5-4 | 590 |
| 7 | 6-4 | 980 |
| 8 | 6-5 | 310 |
| 9 | 6-8 | 450 |
| 10 | 7-3 | 780 |
| 11 | 8-1 | 330 |
| 12 | 8-8 | 300 |
| 13 | 9-2 | 350 |
| 14 | 10-4 | 430 |
| 15 | 10-5 | 500 |
| 16 | 11-10 | 330 |
| 17 | 12-3 | 350 |
| 18 | 13-1 | 480 |
| 19 | 13-2 | 360 |
| 20 | 14-1 | 300 |
| 21 | 2-2 | 850 |
| 22 | 2-9 | 980 |
| 23 | 6-11 | 1,050 |
| 24 | 6-12 | 900 |

TABLE 15-continued

| | Exemplary Compound | Δ500 (V · cm²/μJ) |
|---|---|---|
| 25 | 6-13 | 930 |
| 26 | 6-14 | 1,020 |
| 27 | 10-11 | 600 |
| Comparative Example: | | |
| 1 | Bisazo pigment (A) | 200 |
| 2 | Bisazo pigment (B) | 40 |
| 3 | Bisazo pigment (C) | 70 |
| 4 | Bisazo pigment (D) | 100 |
| 5 | Bisazo pigment (E) | 220 |
| 6 | Bisazo pigment (F) | 180 |

Example 28

A solution prepared by dissolving 5 parts of 6-66-610-12 quadripolyamide copolymer resin in a mixed solvent of 70 parts of methanol and 25 parts of butanol was dip-coated on a cylinder (Rz jis: 1.8 μm) obtained by liquid-honing treatment of an aluminum crude pipe (ED pipe) (available from Showa Denko K.K.; 30 mm in diameter×370 mm in length; Rz jis: 0.8 μm; followed by drying at 100° C. for 10 minutes to form an intermediate layer with a layer thickness of 0.5 μm.

Next, 15 parts of a bisazo pigment (Exemplary Compound 1-8) was added to 215 parts of tetrahydrofuran, and then pre-dispersed at 25° C. for 40 hours by means of a sand mill making use of glass beads of 1 mm in diameter. Further, a solution prepared by dissolving 5 parts of poly(vinyl acetate-co-vinyl alcohol-co-vinyl(p-fluoro)benzal) (degree of benzalation: 85 mol %; weight-average molecular weight: 160,000) in 45 parts of tetrahydrofuran was added, and these were dispersed at 30° C. for 5 hours by means of the sand mill, followed by addition of 150 parts of tetrahydrofuran and 175 parts of cyclohexanone to effect dilution to prepare a charge generation layer coating dispersion. This coating dispersion was dip-coated on the intermediate layer, followed by drying at 90° C. for 10 minutes to form a charge generation layer with a layer thickness of 0.40 μm.

Next, 8 parts of a charge-transporting material (A) having a structure, represented by the following formula:

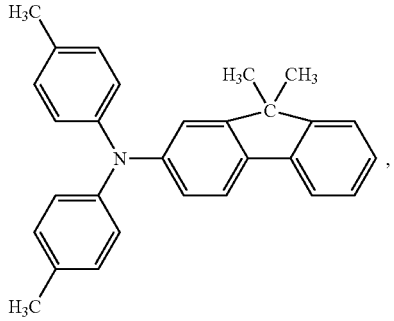

2 parts of a charge-transporting material (B) having a structure represented by the following formula:

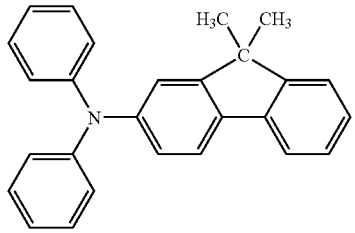

and 10 parts of polycarbonate resin (trade name: IUPILON Z-400; available from Mitsubishi Engineering Plastics Co.) were dissolved in 70 parts of monochlorobenzene to prepare a charge transport layer coating solution, which was then dip-coated on the charge generation layer, followed by drying at 100° C. for 1 hour to form a charge transport layer with a layer thickness of 10 μm.

Next, 36 parts of a charge-transporting material (C) having a structure represented by the following formula:

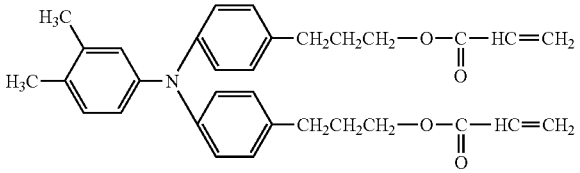

and 4 parts of fine polytetrafluoroethylene resin powder (trade name: LUBRON L-2; available from Daikin Industries, Ltd.) were mixed in 60 parts of n-propyl alcohol. Thereafter, these were subjected to dispersion mixing by means of an ultra-high pressure dispersion machine to prepare a protective layer coating dispersion. Using this coating dispersion, a protective layer was formed by coating on the charge transport layer, and thereafter this was irradiated with electron rays in an atmosphere of nitrogen under conditions of an accelerating voltage of 150 kV and a dose of 1.5 Mrad. Thereafter, heat treatment was subsequently carried out for 3 minutes under conditions which made the photosensitive member have a temperature of 120° C. In this treatment, oxygen concentration was 20 ppm. The photosensitive member was further post-treated at 110° C. for 1 hour in the atmosphere to form a treated protective layer with a layer thickness of 5 μm. Thus, an electrophotographic photosensitive member was obtained.

To the electrophotographic photosensitive member thus obtained, gear and flanges were fitted, and this photosensitive member with gear and franges was set in a full-color copying machine (iRC3200, manufactured by CANON INC.). To a laser exposure optical system of its exposure means, a GaN chip (manufactured by Nichia Kagaku Kogyo K.K.) was mounted, having a lasing wavelength of 407 nm and an output of 5 mW, and the system was so altered as to have a beam spot of 32 μm.

One-dot one-space images and character (5-point) images were reproduced in an environment of 20° C./60% RH, setting charge potential (Vd), light-area potential (Vl) and development bias (Vbis) so as to be −500 V, −200 V and −350 V, respectively. The charge potential (Vd) and the light-area potential (Vl) were measured after 5,000-sheet image reproduction. As the result, they were −505 V and −215 V, respectively. During this image reproduction, the level of variations of Vd and Vl from the initial stage to the finish of 5,000-sheet image reproduction was small (ΔVd=+5 V, ΔVl=+15 V; noted in this way; the same applies hereinafter), showing good results. Also, in visual evaluation of the images reproduced, full-color images having good dot reproducibility and character reproducibility and having a high resolution were obtained from the initial stage up to 5,000-sheet image reproduction.

Examples 29 to 32

The measurement of ΔVd and ΔVl and the visual evaluation of images were made in the same manner as in Example 28 except that the bisazo pigment in the electrophotographic photosensitive member used in Example 28 was respectively changed for Exemplary Compounds shown in Table 16. As the result, it was ascertained that, as shown in Table 16, running potential variations were small like those in Example 28 and full-color images having a high resolution were obtained.

Comparative Examples 7 to 12

The measurement of ΔVd and ΔVl and the visual evaluation of images were made in the same manner as in Example 28 except that the bisazo pigment in the electrophotographic photosensitive member used in Example 28 was respectively changed for bisazo pigments shown in Table 16. As the result, it was ascertained that, as shown in Table 16, in Comparative Examples 8, 9 and 10, the sensitivity was too low for the light-area potential to be set to −200 V however the amount of light was controlled, and also that, in Comparative Examples 7, 11 and 12 the running potential variations were so large that any full-color images having a high resolution were not obtainable throughout running.

TABLE 16

| Example: | Exemplary Compound | ΔVd (V) | ΔVl (V) | Image evaluation |
|---|---|---|---|---|
| 29 | 2-4 | 0 | −5 | Good. |
| 30 | 4-6 | +5 | +15 | Good. |

TABLE 16-continued

| | Exemplary Compound | ΔVd (V) | ΔVl (V) | Image evaluation |
|---|---|---|---|---|
| 31 | 6-1 | +10 | −5 | Good. |
| 32 | 7-5 | +5 | +5 | Good. |
| Comparative Example: | | | | |
| 7 | Bisazo (A) | −20 | −55 | Somewhat crushed line images. |
| 8 | Bisazo (B) | | Vl NG | |
| 9 | Bisazo (C) | | Vl NG | |
| 10 | Bisazo (D) | | Vl NG | |
| 11 | Bisazo (E) | +30 | +60 | Low density. |
| 12 | Bisazo (F) | −25 | −70 | Crushed line images. |

Bisazo: Bisazo pigment; Vl NG: Vl was unable to be set.

Example 33

The measurement of ΔVd and ΔVl and the visual evaluation of images were made in the same manner as in Example 28 except that the charge-transporting materials in the electrophotographic photosensitive member used in Example 28, which were 8 parts of the charge-transporting material (A) and 2 parts of the charge-transporting material (B), were changed for 10 parts of a charge-transporting material (D) having a structure represented by the following formula:

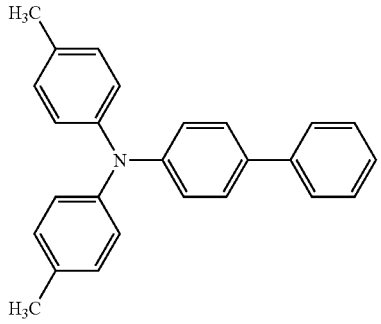

As the result, it was ascertained that ΔVd=+5 V and ΔVl=−10 V, thus running potential variations before and after running were small, showing good results, and also in the visual evaluation of images that full-color images having a high resolution were obtained throughout running.

Example 34

The measurement of ΔVd and ΔVl and the visual evaluation of images were made in the same manner as in Example 28 except that the layer thickness, which was 10 μm, of the charge transport layer of the electrophotographic photosensitive member used in Example 28 was changed to 15 μm and that the protective layer was not formed. As the result, it was ascertained that ΔVd=0 V and ΔVl=+5 V, thus running potential variations before and after running were small, showing good results, and also in the visual evaluation of images that full-color images having a high resolution were obtained throughout running.

Example 35

The measurement of ΔVd and ΔVl and the visual evaluation of images were made in the same manner as in Example 29 except that the support of the electrophotographic photosensitive member used in Example 29, the aluminum crude pipe (ED pipe), was changed for a machined aluminum cylinder (available from Showa Denko K.K.; 30 mm in diameter×370 mm in length; Rz jis: 1.5 μm) and that the charge transport layer was directly formed by coating on the cylinder without forming the intermediate layer and the layer thickness, which was 0.4 μm, of the charge transport layer was changed to 0.6 μm. As the result, it was ascertained that ΔVd=−10 V and ΔVl=−20 V, thus running potential variations before and after running were small, showing good results, and also in the visual evaluation of images that full-color images having a high resolution were obtained throughout running.

Example 36

The measurement of ΔVd and ΔVl and the visual evaluation of images were made in the same manner as in Example 35 except that the layer thickness, which was 10 μm, of the charge transport layer of the electrophotographic photosensitive member in Example 35 was changed to 17 μm and the protective layer was not formed. As the result, it was ascertained that ΔVd=−5 V and ΔVl=−15 V, thus running potential variations before and after running were small, showing good results, and also in the visual evaluation of images that full-color images having a high resolution were obtained throughout running.

Example 37

The measurement of ΔVd and ΔVl and the visual evaluation of images were made in the same manner as in Example 29 except that the binder resin, which was 5 parts of poly (vinyl acetate-co-vinyl alcohol-co-vinyl(p-fluoro)benzal) (degree of benzalation: 85 mol %; weight-average molecular weight: 160,000), of the electrophotographic photosensitive member in Example 29, in the charge generation layer of the electrophotographic photosensitive member in Example 29 was changed to 3 parts of polyvinyl butyral resin (S-LEC BL-S, available from Sekisui Chemical Co., Ltd.). As the result, it was ascertained that ΔVd=−5 V and ΔVl=−10 V, thus running potential variations before and after running were small, showing good results, and also in the visual evaluation of images that full-color images having a high resolution were obtained throughout running.

Example 38

On an aluminum sheet, a solution prepared by dissolving 5 parts of methoxymethylated nylon (average molecular weight: 32,000) and 10 parts of alcohol-soluble copolymer nylon (average molecular weight: 29,000) in 95 parts of methanol was coated by Meyer bar coating, followed by drying at 100° C. for 10 minutes to form a subbing layer with a layer thickness of 1.0 μm.

Next, 0.5 part of a bisazo pigment (Exemplary Compound 1-11) was dispersed in 9.5 parts of 4-methoxy-4-methyl-2-pentanone by stirring for 20 hours by means of a paint shaker together with 22.6 parts of glass beads of 0.8±0.3 mm in diameter. To the dispersion obtained, a solution prepared by dissolving 0.1 part of poly(vinyl acetate-co-vinyl alcohol-co-vinylbenzal) (degree of benzalation: 80 mol %; weight-average molecular weight: 83,000) in 0.9 part of 4-methoxy-4-methyl-2-pentanone was added, and these were further dispersed for 2 hours by means of the paint shaker, followed by addition of 12 parts of methyl ethyl ketone to effect dilution. The dispersion obtained was used as a charge generation layer coating dispersion, and was coated on the subbing layer by Meyer bar coating, followed by drying at 60° C. for 10 minutes to form a charge generation layer with a layer thickness of 0.2 μm.

Next, 10 parts of a charge-transporting material (A) having a structure represented by the following formula:

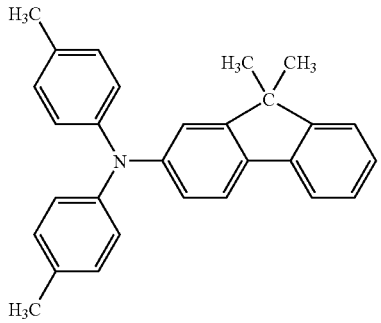

and 10 parts of polycarbonate resin (trade name: IUPILON Z-200; available from Mitsubishi Engineering Plastics Co.) were dissolved in 70 parts of chlorobenzene to prepare a charge transport layer coating solution. This coating solution was then coated by Meyer bar coating on the charge generation layer, followed by drying at 100° C. for 30 minutes to form a charge transport layer with a layer thickness of 20 μm. Thus, a sheetlike electrophotographic photosensitive member was produced.

Figure 8:
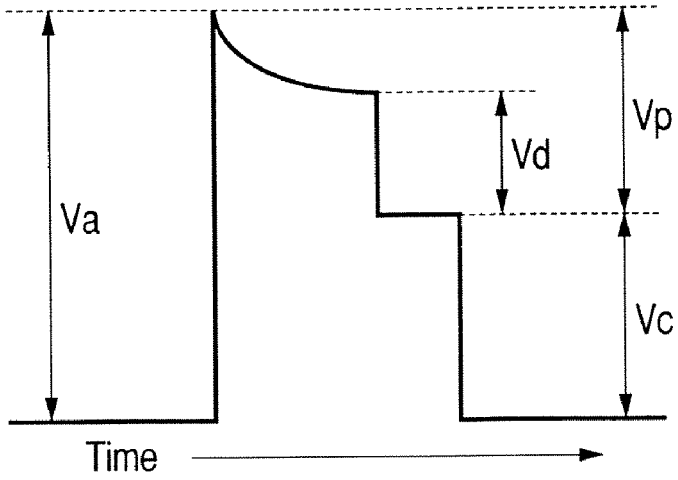
FIG. 8 illustrates a method of measuring the sensitivity of electrophotographic photosensitive members in Examples.

The sensitivity of the electrophotographic photosensitive member produced in Example 38 was measured with an electrophotographic photosensitive member sensitivity measuring instrument of a direct voltage application system making use of NESA glass of 10 $cm^2$ in size. Incidentally, as to measurement sequence, the electrophotographic photosensitive member was regarded as a capacitor, and the sequence of a capacitor model was made up. This measurement is made to proceed as shown in FIG. 8.

Stated specifically, first, in order to remove the history of the electrophotographic photosensitive member, the electrophotographic photosensitive member was irradiated with exposure light (imagewise exposure light) and pre-exposure light, and, 10 milliseconds later, a stated voltage Va was applied to the electrophotographic photosensitive member. Next, 20 milliseconds later, its potential (Vd+Vc) was measured. After the measurement, the potential of the electrophotographic photosensitive member was dropped to that of ground. Next, the potential Vc was measured. The Vd determined from these results was regarded as the potential of the electrophotographic photosensitive member. Here, after 20 milliseconds at the time the Vd came to be −700 V, the photosensitive member was irradiated with light of 403 nm in exposure wavelength (imagewise exposure wavelength), and, 95 milliseconds later, its surface potential was measured. As a light source, used was a halogen lamp having been made monochromatic using an interference filter of 403 nm in wavelength. The NESA sensitivity was determined from the amount of light at which the surface potential came to be −200 V as a result of exposure (imagewise exposure). As the result, the sensitivity was 820 ($V \cdot cm^2/\mu J$), which was a very high sensitivity.

Examples 39 to 50

The sensitivity ($V \cdot cm^2/\mu J$) was measured in the same manner as in Example 38 except that the bisazo pigment in the electrophotographic photosensitive member used in Example 38 was respectively changed for Exemplary Compounds shown in Table 17. As the result, it was ascertained that electrophotographic photosensitive members had a very high sensitivity as shown in Table 17.

TABLE 17

| Example: | Exemplary Compound | Sensitivity ($V \cdot cm^2/\mu J$) |
|---|---|---|
| 39 | 1-12 | 880 |
| 40 | 1-13 | 1,200 |
| 41 | 1-14 | 1,180 |
| 42 | 1-15 | 1,000 |
| 43 | 2-11 | 1,030 |
| 44 | 2-12 | 1,020 |
| 45 | 2-13 | 1,180 |
| 46 | 2-14 | 1,160 |
| 47 | 3-4 | 940 |
| 48 | 7-11 | 1,280 |
| 49 | 7-12 | 1,410 |
| 50 | 7-13 | 1,450 |

Examples 51 to 73

Electrophotographic photosensitive members were produced in the same manner as in Example 38 except that the bisazo pigment in the electrophotographic photosensitive member used in Example 38 was respectively changed for Exemplary Compounds shown in Table 18 below. Next, in the electrophotographic photosensitive member sensitivity measuring instrument used in Example 38, the sensitivity of each of the electrophotographic photosensitive members according to Examples 51 to 73 was measured in the same manner as in Example 38 except that the interference filter of 403 nm in wavelength was changed for a G54 color filter and also that, as to the NESA sensitivity, the one determined from the amount of light at which the surface potential came to be −200 V as a result of exposure (imagewise exposure) was changed to the one determined from the amount of light at which the surface potential came to be −350 V as a result of exposure (imagewise exposure).

The electrophotographic photosensitive members (sheets) were further each stuck to a cylinder for an analogue copying machine (NP6035, manufactured by CANON INC.). Setting dark-area potential Vd and light-area potential Vd at the initial-stage to −700 V and −200 V, respectively, each photosensitive member was repeatedly used 30,000 times, where the variation level of the dark-area potential, ΔVd, and the variation level of the light-area potential, ΔVl, were measured in two environments, a low-temperature and low-humidity environment of 15° C./10% RH (L/L) and a high-temperature and high-humidity environment of 35° C./85% RH (H/H)

Results of the above measurement are shown in Table 18 together. In Table 18, the negative sign in the variation level of potential stands for a decrease in absolute value of the potential, and the positive sign in the variation level of potential stands for an increase in absolute value of the potential.

As shown in Table 18 below, the bisazo pigment used in each of the present Examples afforded a high sensitivity in respect of white color or the like of a halogen light source or the like. Further, potential variations of ΔVd and ΔVl in the high-temperature and high-humidity environment and low-temperature and low-humidity environment were small. In regard to the bisazo pigments in Examples 51 to 63, they were so good as to afford especially high sensitivity and small potential variations.

TABLE 18

| Example: | Exemplary Compound | Sensitivity (lux · sec) | Running variations in L/L ΔVd | ΔVl | in H/H ΔVd | ΔVl |
|---|---|---|---|---|---|---|
| 51 | 2-4 | 2.5 | 0 | 0 | 0 | −5 |
| 52 | 1-11 | 2.8 | +5 | 0 | −5 | 0 |
| 53 | 1-12 | 3.2 | +5 | +10 | −5 | −10 |
| 54 | 2-10 | 3.0 | +5 | +5 | −10 | −15 |
| 55 | 2-9 | 2.9 | −5 | −5 | 0 | 0 |
| 56 | 3-4 | 2.7 | 0 | +5 | 0 | −5 |
| 57 | 1-13 | 3.3 | +15 | +20 | −5 | −10 |
| 58 | 1-14 | 3.4 | +10 | +15 | −10 | −15 |
| 59 | 1-15 | 3.3 | +5 | +10 | −15 | −20 |
| 60 | 2-11 | 3.5 | +5 | +10 | −10 | −15 |
| 61 | 2-12 | 3.2 | +5 | +5 | −5 | −15 |
| 62 | 2-13 | 3.2 | +5 | +10 | −15 | −20 |
| 63 | 2-14 | 3.4 | +10 | +5 | −20 | −15 |
| 64 | 1-8 | 4.2 | −10 | +30 | −15 | −40 |
| 65 | 2-2 | 4.0 | −10 | +25 | −20 | −30 |
| 66 | 3-11 | 5.6 | +10 | +30 | +10 | +30 |
| 67 | 3-12 | 5.0 | +15 | +25 | −10 | −45 |
| 68 | 4-11 | 6.2 | +30 | +35 | −20 | −30 |
| 69 | 3-13 | 4.7 | +35 | +20 | −15 | −30 |
| 70 | 3-14 | 4.8 | +35 | +40 | −15 | −35 |
| 71 | 6-2 | 4.3 | +10 | +25 | −10 | −35 |
| 72 | 7-5 | 4.0 | +15 | +20 | −15 | −40 |
| 73 | 10-11 | 4.5 | +10 | +25 | −15 | −30 |

This application claims priority from Japanese Patent Application No. 2003-395880 filed Nov. 26, 2003, which is hereby incorporated by reference herein

What is claimed is:

1. An electrophotographic photosensitive member comprising: a support and a photosensitive layer, wherein said photosensitive layer comprises at least one selected from the group consisting of bisazo pigments represented by the following Formulas (7) and (8):

Formula (7)

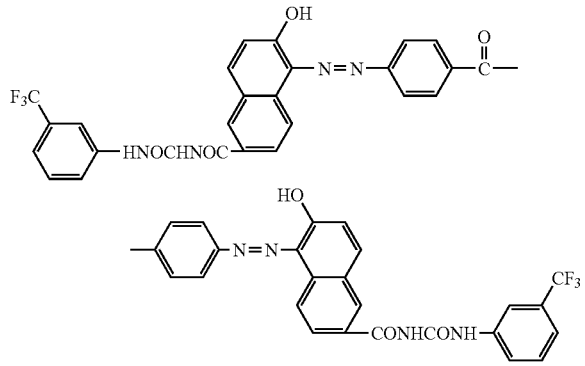

Formula (8)

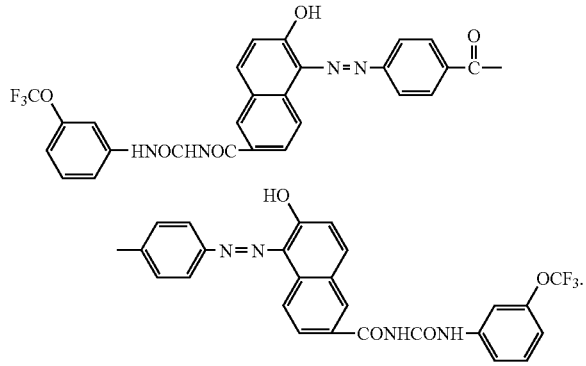

2. An electrophotographic photosensitive member comprising:

a support and a photosensitive layer, wherein said photosensitive layer comprises at least one selected from the group consisting of bisazo pigments represented by the following Formulas (11) to (21):

Formula (11)

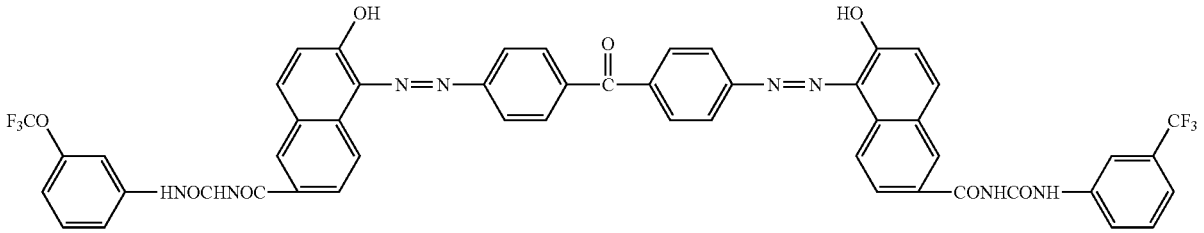

Formula (12)

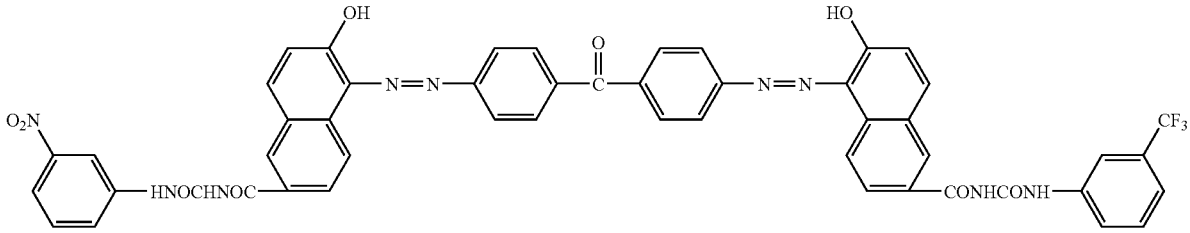

-continued
Formula (13)
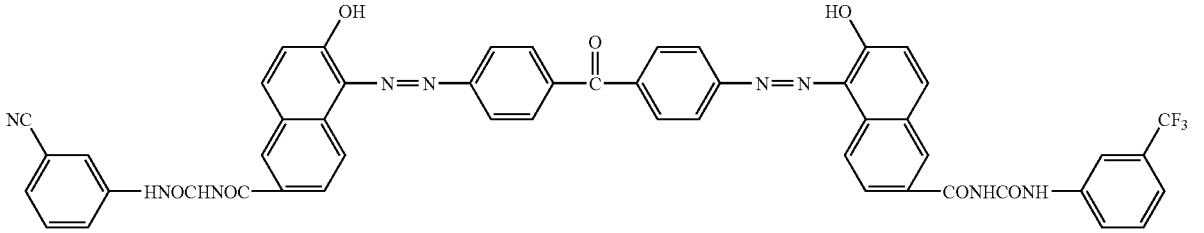
Formula (14)
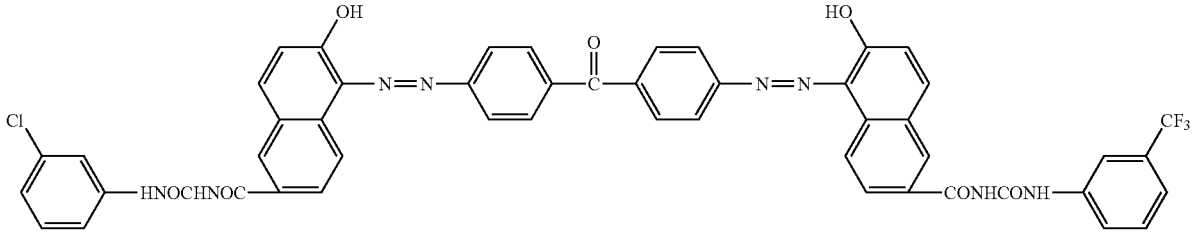
Formula (15)
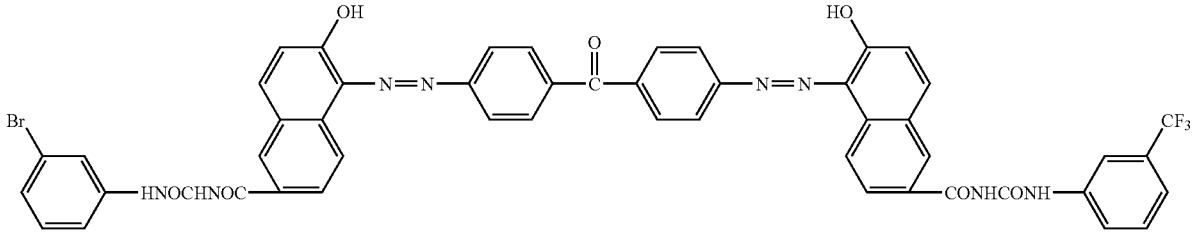
Formula (16)
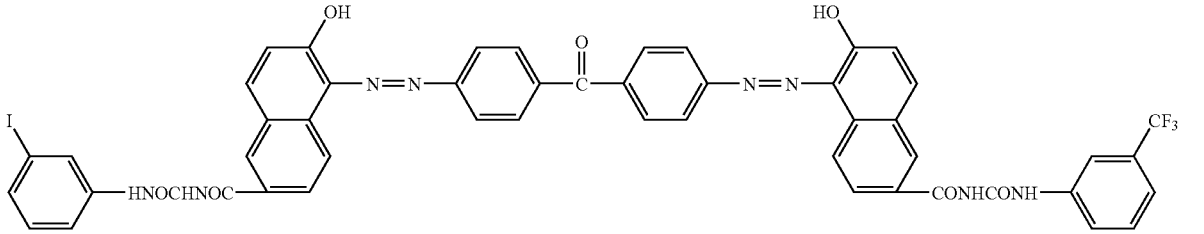
Formula (17)
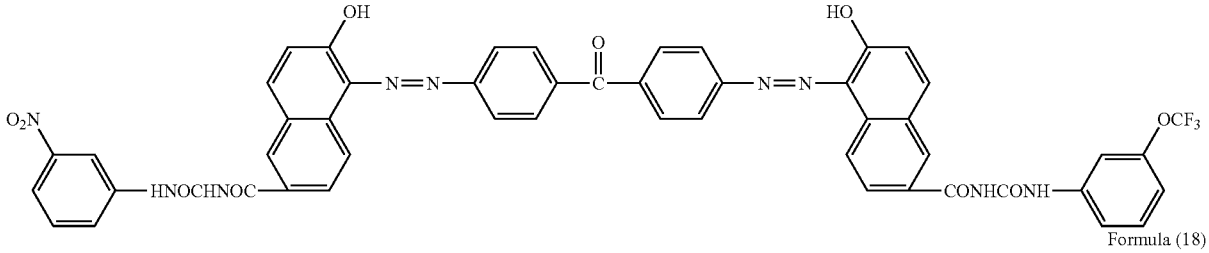
Formula (18)
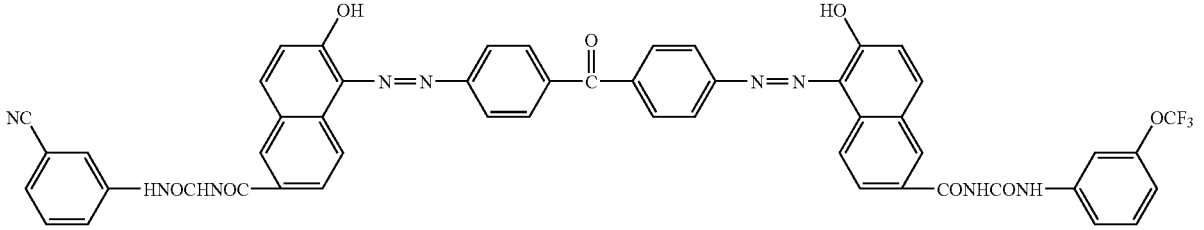

-continued

Formula (19)

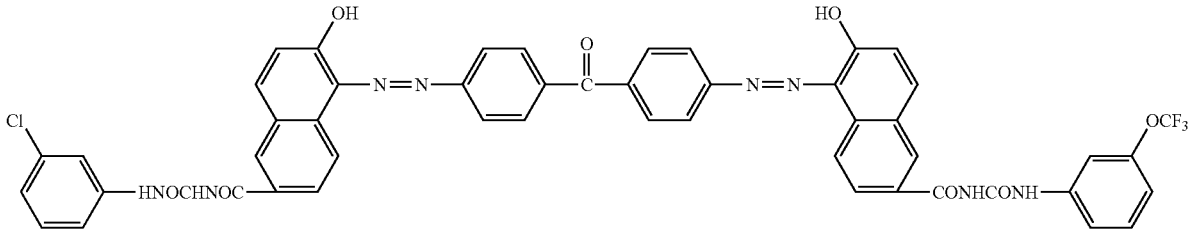

Formula (20)

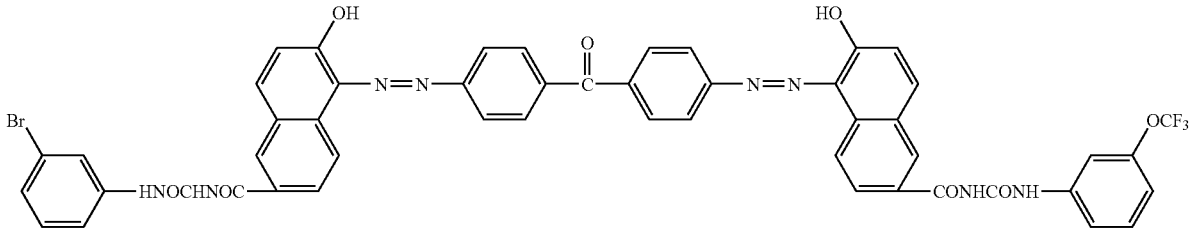

Formula (21)

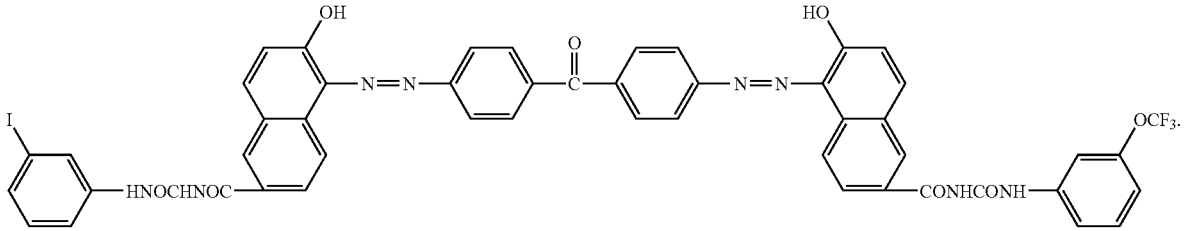

3. An electro photographic apparatus which comprises the electrophotographic photosensitive member according to claim 1, a charging means, an exposure means, a developing means and a transfer means.

4. An electrophotographic apparatus which comprises the electrophotographic photosensitive member according to claim 2, a charging means, an exposure means, a developing means and a transfer means.

5. An electrophotographic apparatus comprising: an electrophotographic photosensitive member, a charging means, an exposure means comprising a semiconductor laser light source of a semiconductor laser light having a wavelength of from 380 to 500 nm, and a developing means, wherein said electrophotographic photosensitive member comprises a support and a photosensitive layer sensitive to the semiconductor laser light, and wherein said photosensitive layer comprises a bisazo pigment represented by the following Formula:

Formula (1)

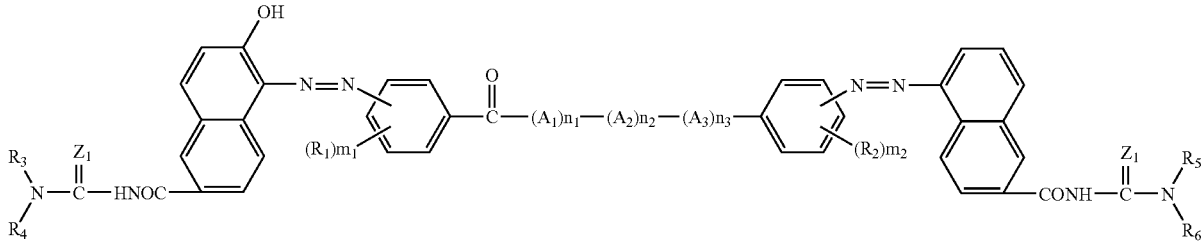

wherein, $R_1$ and $R_2$ each independently represent an alkyl group which may have a substituent, or a halogen atom, $n_1$, $n_2$ and $n_3$ are 0, $R_3$ and $R_5$ are each a hydrogen atom, $R_4$ and $R_6$ are each independently a phenyl group having a sole substituent at 3 position thereof, said substituent being selected from the group consisting of a chlorine atom, a fluorine atom, a bromine atom, an iodine atom, a nitro group, a trifluoromethyl group, a trifluoromethoxyl group, an acetyl group and a cyano group, $Z_1$ and $Z_2$ are each an oxygen atom, and $m_1$ and $m_2$ each represent an integer of 0 to 4.

6. An electrophotographic apparatus comprising: an electrophotographic photosensitive member, a charging means, an exposure means comprising a semiconductor laser light source of a semiconductor laser light having a wavelength of from 380 to 500 nm, and a developing means, wherein said electrophotographic photosensitive member comprises a support and a photosensitive layer sensitive to the semiconductor laser light, and wherein said photosensitive layer comprises a bisazo pigment represented by the following Formula:

Formula (1)

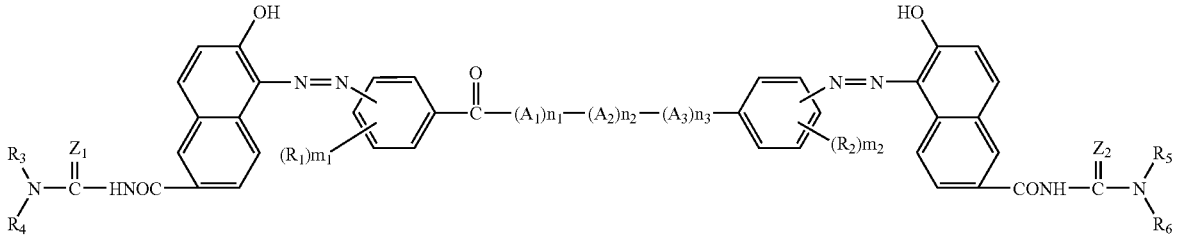

wherein, $R_1$ and $R_2$ each independently represent an alkyl group which may have a substituent, or a halogen atom, $n_1$, $n_2$ and $n_3$ are each $A_1$ and $A_2$ are each a group represented by the following Formula (3), and $A_3$ is a group represented by the following Formula (4):

Formula (3)

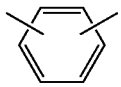

Formula (4)

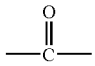

$R_3$ and $R_5$ are each a hydrogen atom, $R_4$ and $R_6$ are each independently a phenyl group having a sole substituent at 3 position thereof, said substituent being selected from the group consisting of a chlorine atom, a fluorine atom, a bromine atom, an iodine atom, a nitro group, a trifluoromethyl group, a trifluoromethoxyl group, an acetyl group and a cyano group, $Z_1$ and $Z_2$ are each an oxygen atom, and $m_1$ and $m_2$ each represent an integer of 0 to 4.

* * * * *